US011673711B2

(12) United States Patent
Brenner

(10) Patent No.: US 11,673,711 B2
(45) Date of Patent: Jun. 13, 2023

(54) FLUID CONTAINER RETAINING SYSTEMS AND METHODS

(71) Applicant: iSee Store Innovations, L.L.C., St. Louis, MO (US)

(72) Inventor: Steven Allen Brenner, Richmond Heights, MO (US)

(73) Assignee: iSee Store Innovations, L.L.C., St. Louis, MO (US)

( * ) Notice: Subject to any disclaimer, the term of this patent is extended or adjusted under 35 U.S.C. 154(b) by 131 days.

(21) Appl. No.: 16/983,124

(22) Filed: Aug. 3, 2020

(65) Prior Publication Data

US 2022/0033141 A1 Feb. 3, 2022

(51) Int. Cl.

| | |
|---|---|
| ***B65D 23/00*** | (2006.01) |
| ***B65D 23/06*** | (2006.01) |
| ***A47K 5/12*** | (2006.01) |

(52) U.S. Cl.

CPC ..... *B65D 23/003* (2013.01); *A47K 5/1205* (2013.01); *B65D 23/001* (2013.01); *B65D 23/065* (2013.01); *A47K 2201/02* (2013.01)

(58) Field of Classification Search

CPC .. B65D 23/003; B65D 23/001; B65D 23/065; A47K 5/1205; A47K 2201/02

See application file for complete search history.

(56) References Cited

U.S. PATENT DOCUMENTS

| | | | | |
|---|---|---|---|---|
| 2,657,893 A | | 11/1953 | Puckert | |
| 2,940,713 A | | 6/1960 | Van Dusen | |
| 2,953,283 A | * | 9/1960 | Palkowski | B65D 83/208 222/402.15 |
| 4,133,575 A | | 1/1979 | Mader | |
| 5,104,077 A | | 4/1992 | Liu | |
| 5,318,262 A | | 6/1994 | Adams | |
| 5,489,890 A | * | 2/1996 | Moser | G08B 13/08 200/61.93 |
| 5,499,748 A | * | 3/1996 | Iaia | B65D 23/003 248/205.5 |
| 5,749,490 A | * | 5/1998 | Keicher | B65D 23/003 220/759 |
| 6,065,649 A | * | 5/2000 | Scoggins | B67D 3/00 141/237 |

(Continued)

FOREIGN PATENT DOCUMENTS

| | | | |
|---|---|---|---|
| CN | 207202799 | * | 4/2018 |
| CN | 207202799 U | * | 4/2018 |

(Continued)

OTHER PUBLICATIONS

U.S. Appl. No. 16/864,310, filed May 1, 2020.

*Primary Examiner* — Bob Zadeh

(74) *Attorney, Agent, or Firm* — The Small Patent Law Group LLC; Joseph M. Butscher

(57) ABSTRACT

A fluid container retaining system includes a cover, and a support mount configured to cooperate with the cover to securely retain a first portion of a fluid container. The support mount includes a securing assembly having a suction cup that is configured to removably secure the fluid container retaining system to a surface of a structure. A stand is configured to secure to a second portion of the fluid container.

28 Claims, 22 Drawing Sheets

(56) References Cited

U.S. PATENT DOCUMENTS 6,209,184 B1 * 4/2001 Copeland ..... A47K 5/12 264/219
6,478,271 B1 11/2002 Mulholland
6,502,794 B1 1/2003 Ting
6,666,420 B1 12/2003 Carnevali
6,669,033 B1 12/2003 Lian
6,827,243 B1 * 12/2004 Nuzzolese ..... B67D 1/0051 222/269
6,942,188 B2 9/2005 Tsay
6,966,530 B2 11/2005 Hsu
7,458,541 B1 12/2008 Chang
7,708,245 B2 5/2010 Woo
7,793,899 B2 9/2010 Fan
7,850,133 B2 12/2010 Carnevali
8,079,557 B2 12/2011 Tu
9,200,667 B1 12/2015 Hsu
9,404,526 B2 8/2016 Huang
9,410,571 B2 8/2016 Yang
10,393,168 B2 8/2019 Schaefer
2003/0141984 A1 * 7/2003 Sarek, Jr. ..... G08B 7/068 340/815.4
2003/0160066 A1 * 8/2003 Houvras ..... B65D 23/003 222/181.3
2004/0206867 A1 * 10/2004 Zhadanov ..... A47K 10/04 248/206.3
2005/0017146 A1 * 1/2005 Kringel ..... A47F 7/283 248/313
2007/0221801 A1 * 9/2007 Jensen ..... F16B 47/00 248/206.2
2008/0308693 A1 * 12/2008 Kim ..... A47G 29/08 248/205.8
2014/0227411 A1 * 8/2014 Popeil ..... A23L 5/11 220/573.1
2014/0263909 A1 * 9/2014 Tsai ..... A47J 47/16 248/313
2014/0374553 A1 12/2014 Park
2015/0240862 A1 8/2015 Shi
2015/0306622 A1 * 10/2015 Ashworth ..... F16M 13/022 248/205.8
2015/0369276 A1 12/2015 Balmer
2016/0201714 A1 7/2016 Zhang
2016/0215813 A1 7/2016 Huang
2016/0288151 A1 * 10/2016 Schultz ..... F16B 5/0657

FOREIGN PATENT DOCUMENTS

DE 202015103187 U1 * 7/2016
DE 202017005290 * 11/2017 ..... A47K 5/12
DE 102020008002 A1 * 9/2021
JP H0666683 * 9/1994
JP 2008229296 A * 10/2008
JP 2011110252 A * 6/2011
JP 2022046009 A * 3/2022

* cited by examiner

FLUID CONTAINER RETAINING SYSTEMS AND METHODS

FIELD OF EMBODIMENTS OF THE DISCLOSURE

Embodiments of the present disclosure generally relate to fluid container retaining systems and methods, which may be used to removably secure a fluid container, such as a container of hand sanitizer, to a structure.

BACKGROUND OF THE DISCLOSURE

Various fluid containers are used to retain fluid and allow the fluid to be dispensed therefrom. For example, hand sanitizer may be retained within a bottle and dispensed via a pump coupled to the bottle. As another example, liquid or foam soap may be dispensed from a bottle. As still another example, hair care products such a shampoo, conditioner, styling mousse, and the like may also be dispensed from bottles via pumps or other such delivery devices.

With heightened concern regarding the spread of pathogens, grocery stores, conveniences stores, restaurants, and other establishments may provide hand sanitizer to customers. Typically, the hand sanitizer is disposed on a counter or the like. As such, the hand sanitizer may not be readily visible to patrons within an establishment. Further, the hand sanitizer may be easily removed from the location.

SUMMARY OF THE DISCLOSURE

A need exists for a fluid container retaining system that is readily visible within an establishment, such as a grocery store, convenience store, restaurant, or the like. Further, a need exists for a fluid container retaining system that ensures that a fluid container is not inadvertently displaced, removed, or the like.

With those needs in mind, certain embodiments of the present disclosure provide a fluid container retaining system including a cover, and a support mount configured to cooperate with the cover to securely retain a first portion of a fluid container. The support mount includes a securing assembly having a suction cup that is configured to removably secure the fluid container retaining system to a surface of a structure.

In at least one embodiment, the fluid container retaining system further includes a stand configured to secure to a second portion of the fluid container. The first portion of the fluid container may be a neck, and the second portion of the fluid container may be a lower end.

The stand may include a drip chamber configured to catch fluid dispensed from a pump of the fluid container, and a bottle retaining chamber configured to retain the second portion of the fluid container. The bottle retaining chamber is separated from the drip chamber.

The stand may include a base having a flat surface that is configured to be supported on a level surface. The stand may include an opening. The stand may be configured to be mounted over a portion of the fluid container and provide a filling device for the fluid container through the opening.

In at least one embodiment, the cover and the support mount are configured to snapably secure together to trap the first portion of the fluid container therebetween.

In at least one embodiment, the securing assembly of the support mount includes a securing rim having a passage, a suction cup having a stem, wherein the stem extends into and through the passage, and a suction securing nut that secures to the stem. The securing rim may also include a locking member.

In at least one embodiment, the securing assembly may include an adhesive disc secured to the suction cup.

In at least one embodiment, the support mount is configured to removably retain a sign.

In at least one embodiment, the fluid container retaining system also includes a floor stand that is configured to support the fluid container above a floor. In at least one example, the securing assembly secures the support mount to the floor stand. At least a portion of the suction cup may be removable from the securing assembly.

In at least one embodiment, the floor stand includes a floor mount, and an extension beam upwardly extending from the floor mount. A stand that supports the fluid container is secured to the extension beam.

The extension beam may include a plurality of segments. At least two of the plurality of segments may be adjustable.

Certain embodiments of the present disclosure provide a method including securely retaining a first portion of a fluid container between a support mount and a cover of a fluid container retaining system, and removably securing the fluid container retaining system to a surface of a structure by a suction cup of a securing assembly of the support mount. In at least one embodiment, the method also includes securing a second portion of the fluid container to a stand of the fluid container retaining system.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a fluid container retaining system that is configured to retain a fluid container and allow fluid to be dispensed from the fluid container. In at least one embodiment, the fluid is hand sanitizer. As another example, the fluid is liquid or foam soap. As another example, the fluid is a hair care product, such as shampoo or conditioner. In at least one other embodiment, the fluid may be a consumable fluid, such as a beverage, condiment, sauce, or the like.

Figure 1:
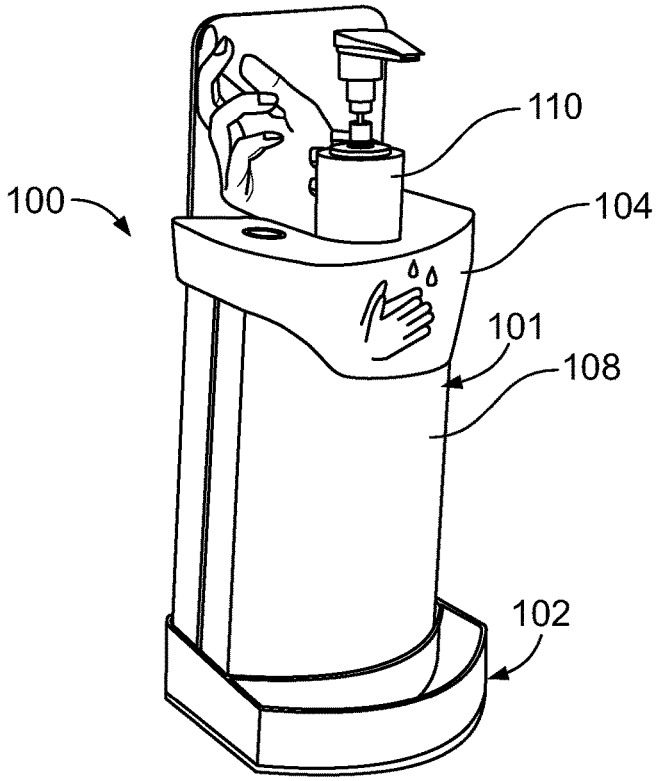
FIG. 1 illustrates a perspective front view of a fluid container retaining system that retains a fluid container, according to an embodiment of the present disclosure.
Figure 2:
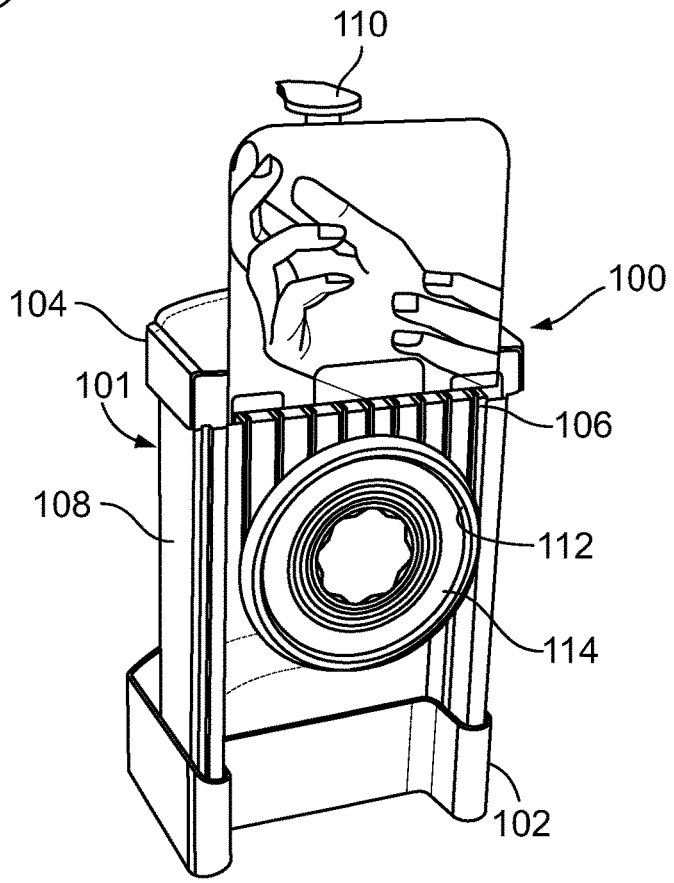
FIG. 2 illustrates a perspective rear view of the fluid container retaining system that retains the fluid container.

FIG. 1 illustrates a perspective front view of a fluid container retaining system 100 that retains a fluid container 101, according to an embodiment of the present disclosure. FIG. 2 illustrates a perspective rear view of the fluid container retaining system 100 that retains the fluid container 101. Referring to FIGS. 1 and 2, the fluid container retaining system 100 includes a stand 102, a cover 104, and a support mount 106 that couples to the cover 104.

The fluid container retaining system 100 includes the cover 104 and the support mount 106, which is configured to cooperate with the cover 104 to securely retain a portion of the fluid container 101. In at least one embodiment, the support mount 106 includes comprises a securing assembly 112 having a suction cup 114 that is configured to removably secure the fluid container retaining system 100 to a surface of a structure.

Certain embodiments of the present disclosure provide the fluid container retaining system 100 including the stand 102 which is configured to secure to a portion of the fluid container 101, such as a lower end 134 of the fluid container 101. The fluid container retaining system 100 further includes the cover 104 and the support mount 106 that cooperate to securely retain a portion of the fluid container 101, such as a neck 109 of the fluid container 101. Further, the support mount 106 is configured to secure to a surface of a structure, thereby securing the fluid container 101 to the structure. For example, the support mount 106 includes the suction cup 114 that secures to the surface of the structure.

The fluid container 101 includes a bottle 108 that defines an interior chamber that retains a fluid, and a pump 110 that removably connects to the bottle 108 and is configured to be operated to dispense the fluid from the bottle 108. In at least one embodiment, the fluid container 101 is a container of hand sanitizer. As another example, the fluid container is a container of liquid or foam soap. As another example, the fluid container is a container of a hair care product, such as shampoo, conditioner, or the like. As another example, the fluid container is a container of a consumable fluid, such as a beverage, a condiment or sauce, or the like. The bottle 108 may be sized and shaped differently than shown. The fluid container retaining system 100 is configured to retain the fluid container 101.

In at least one embodiment, the fluid container retaining system 100 is configured to secure to a structure, such as via the securing assembly 112 of the support mount 106. In at least one embodiment, the securing assembly 112 includes the suction cup 114 that is configured to secure to a surface of a component, such as a glass door of a refrigerated compartment, a mirror, a window, and/or the like. The securing assembly 112 may also include a locking member, such as a locking ring, as described herein.

As shown, the stand 102 may be separated from the cover 104 and the support mount 106. That is, the stand 102 may not be directly connected to the cover 104 and the support mount 106. Instead, the stand 102 may connect to the cover 104 and the support mount 106 through the fluid container 101. As such, when the fluid container 101 is removed, the stand 102 may be disconnected from the cover 104 and the support mount 106. In this manner, the fluid container retaining system 100 is adaptable to bottles 108 of different lengths.

Figure 3:
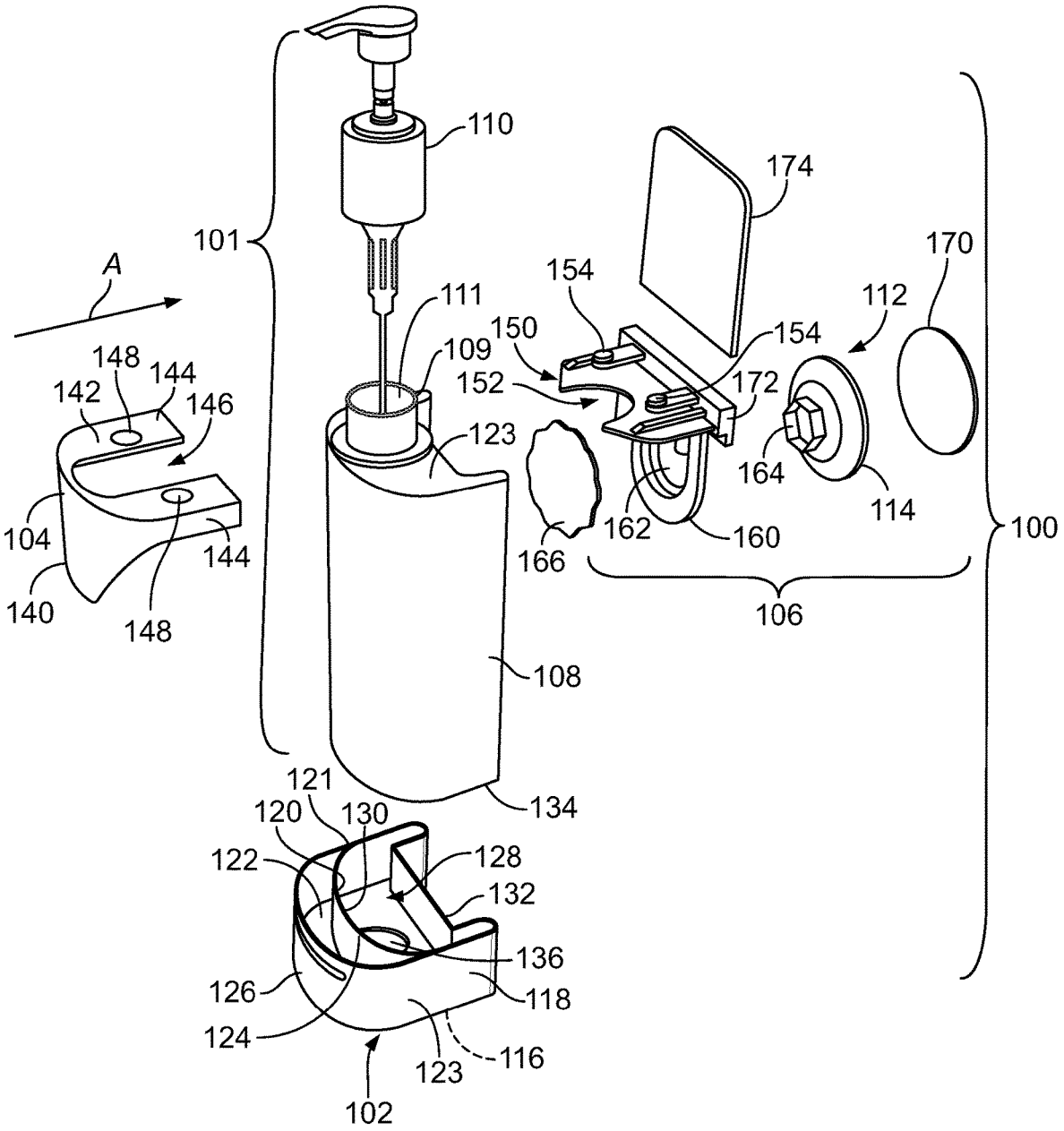
FIG. 3 illustrates a perspective exploded view of the fluid container retaining system that is configured to retain the fluid container.

FIG. 3 illustrates a perspective exploded view of the fluid container retaining system 100 that is configured to retain the fluid container 101. The stand 102 of the fluid container retaining system 100 includes a base 116 and perimeter walls 118 upwardly extending from the base 116. An interior wall 120 extends upwardly from the base 116. For example, the interior wall 120 extends between opposite side walls 121 and 123. A drip chamber 122 is defined between a front surface 124 of the interior wall 120, a front wall 126, and the side walls 121 and 123. The drip chamber 122 is configured to catch and retain fluid that drips, leaks, or is otherwise inadvertently dispensed from the pump 110.

A bottle retaining chamber 128 is defined between a rear surface 130 of the interior wall 120, a rear wall 132, and the side walls 121 and 123. The bottle retaining chamber 128 is sized and shaped to retain a portion of the bottle 108, such as a lower end 134 (for example, a lower half, third, quarter, tenth, or the like of a height or length) of the bottle 108. In at least one embodiment, the lower end 134 is retained within the bottle retaining chamber 128 via a press and/or interference fit. As another example, the bottle retaining chamber 128 may be configured to snapably or latchably retain the lower end 134.

As described herein, the stand 102 includes the drip chamber 122 configured to catch fluid dispensed from the pump 110 of the fluid container 101, and the bottle retaining chamber 128 configured to retain a portion (such as the lower end 134) of the fluid container 101. The bottle retaining chamber 128 is separated from the drip chamber 122, such as by the interior wall 120.

In at least one embodiment, the base 116 is a flat surface. As such, the base 116 provides a mounting surface that allows the fluid container retaining system 100 and the bottle 108 to be supported on a surface, such as a countertop, shelf, or the like.

An opening 136 may be formed through the base 116. For example, the opening 136 may be formed through the base 116 and provide a passage between the bottle retaining chamber 128 and out of the stand 102 through the opening 136. The stand 102 may be mounted onto a neck 109 of the bottle 108 when the pump 110 is removed such that the opening 136 is axially aligned with a fluid passage 111 defined by the neck 109. In this manner, the stand 102 may optionally also be used as a filling device, such as a funnel, to refill the bottle 108 with fluid, such as hand sanitizer.

The cover 104 includes a front wall 140 that downwardly extends from a collar 142. The collar 142 includes lateral prongs 144 separated by a central channel 146 that is configured to fit around a circumferential portion of the neck 109 of the bottle 108. Securing passages 148 are formed through the lateral prongs 144.

The support mount 106 includes a bracket 150 defining a central recess 152 that is configured around a circumferential portion of the neck 109 of the bottle 108 opposite from the central channel 146 of the collar 142. Snap protuberances (such as studs, nubs, posts, or the like) 154 extend from the bracket 150 and are configured to snapably secure within the securing passages 148 of the lateral prongs 144 when the cover 104 is mated with the support mount 106. Optionally, the support mount 106 may include the securing passages 148, and the cover 104 may include the snap protuberances 154. When the cover 104 is aligned within the support mount 106 such that the neck 109 is positioned between central channel 146 of the collar 142 and the central recess 152 of the bracket 150, the cover 104 is urged toward and into the support mount 106 in the direction of arrow A, thereby trapping the neck 109 within the central passage 146 and the central recess 152, and snapably securing the cover 104 to the support mount 106 through the snap protuberances 154 snapably securing into the securing passages 148. As such, in at least one embodiment, the cover 104 and the support mount 106 are configured to snapably secure together to trap and constrain the neck 109 of the fluid container 101 therebetween. In this manner, the fluid container 101 is not able to be lifted out of the fluid container retaining system 100 as the body of the bottle 108 is too large to fit through the opening defined by the central channel 146 of the cover 104 and the central recess 152 of the support mount 106.

The central channel 146 and the central recess 152 define a neck channel into which the neck 109 is disposed. Portions of collar 142 and the bracket 150 may include securing members, such as clasps, snaps, latches, or the like that are configured to securely constrain the neck 109 and therefore secure the fluid container 101 in position. In at least one embodiment, the rear wall 132 of the stand 102 is configured to abut against a surface of a component to further stabilize the fluid container 101.

A securing rim 160 downwardly extends from the bracket 150. For example, the securing rim 160 may be orthogonal to the bracket 150. The securing rim 160 includes a passage 162 that receives and retains a stem 164 of the suction cup 114 so that a suction securing nut 166 secures to the suction cup 114. In at least one embodiment, the suction cup 114, the securing rim 160, and the suction securing nut 166 form the securing assembly 112. In at least one embodiment, the securing rim 160 includes a locking member, such as a locking ring, as described herein.

In at least one embodiment, the securing assembly 112 may include an optional adhesive disc 170. The adhesive disc 170 may be double sided tape, for example, and is configured to adhesively couple to a rear of the suction cup 114 and a surface of a structure. The adhesive disc 170 may be or include a panel having adhesive (such as tape, glue, or the like) on one other both sides. The adhesive disc 170 may be used to secure the fluid container retaining system 100 to structures to which the suction cup 114 may not be configured to securely couple. Optionally, the securing assembly 112 may not include the adhesive disc 170.

A sign beam 172 may extend from a rear of the bracket 150. The sign beam 172 may include one or more of a slot, clips, or the like that are configured to removably support and retain a sign 174. Optionally, the support mount 106 may not include the sign beam 172 or the sign 174.

Figure 4:
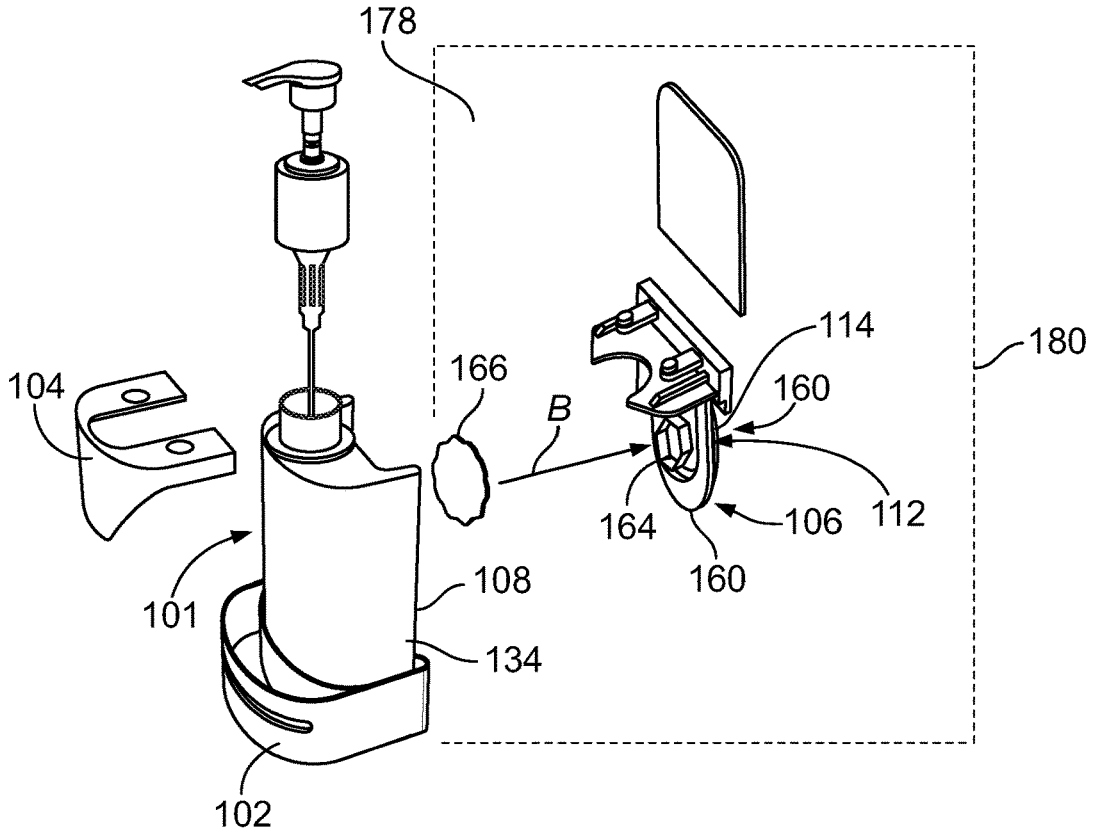
FIG. 4 illustrates a perspective view of a support mount of the fluid container retaining system initially coupled to a surface of a structure, according to an embodiment of the present disclosure.

FIG. 4 illustrates a perspective view of the support mount 106 of the fluid container retaining system 100 initially coupled to a surface 178 of a structure 180, according to an embodiment of the present disclosure. The structure 180 may be a refrigerated compartment, and the surface 178 may be a glass door of the refrigerated compartment, for example.

In order to securely mount the fluid container 101 to the structure 180, the stand 102 is first secured to the lower end 134 of the bottle 108, as described above. For example, the lower end 134 is secured within the bottle retaining chamber 128 of the stand 102, as described with respect to FIG. 3. Optionally, the stand 102 need not be secured to the bottle 108.

The suction cup 114 is secured to the surface 178 of the structure 180. The securing rim 160 is then moved onto the stem 164 of the suction cup 114. The stem 164 extends through the passage of the securing rim 160. The suction securing nut 166 is then axially aligned with the stem 164 and urged into the stem 164 in the direction of arrow B.

Figure 5:
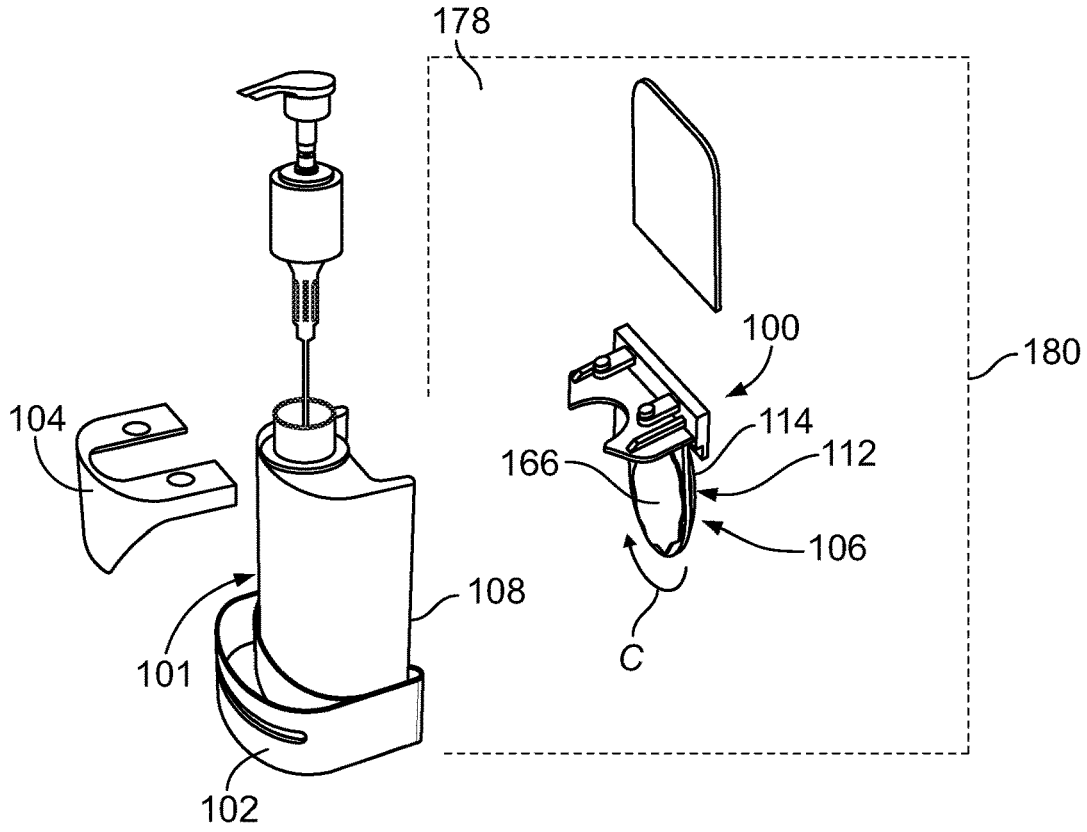
FIG. 5 illustrates a perspective view of the support mount of the fluid container retaining system secured to the surface of the structure.

FIG. 5 illustrates a perspective view of the support mount 106 of the fluid container retaining system 100 secured to the surface 178 of the structure 180. After the suction securing nut 166 is moved onto the stem 164 (shown in FIG. 4), the suction securing nut 166 is rotated in the direction of arc C, thereby securely locking the support mount 106 in position.

Figure 6:
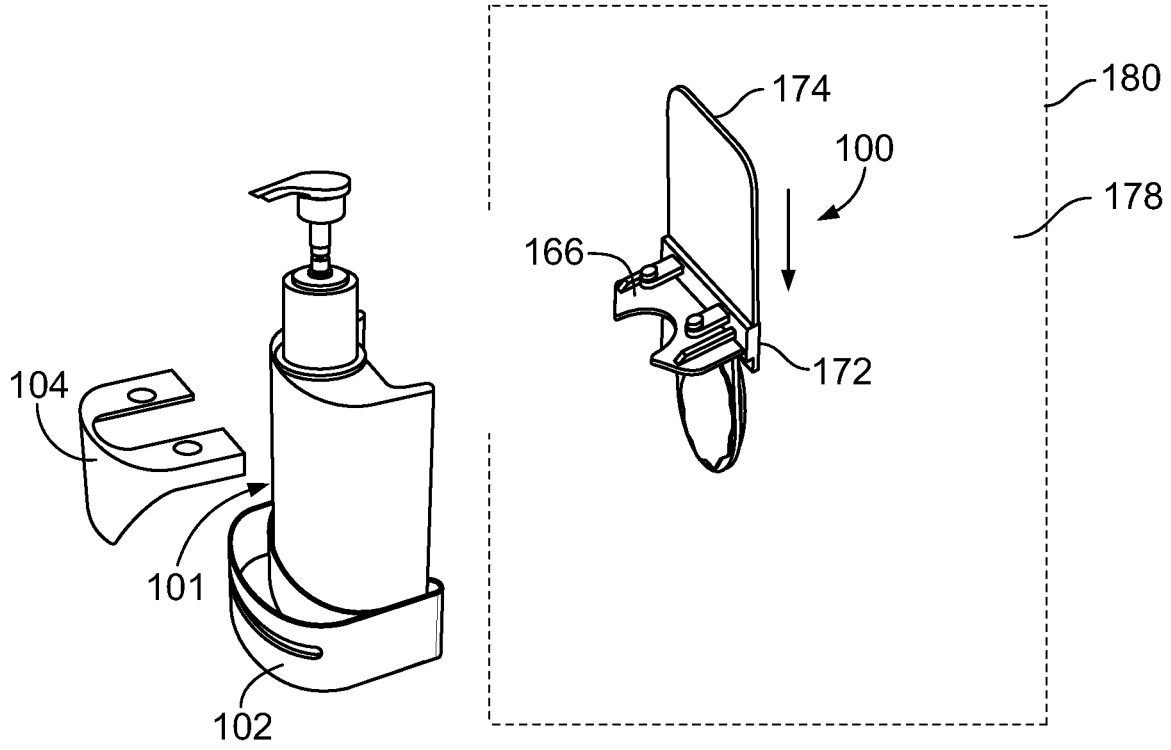
FIG. 6 illustrates a perspective view of a sign mounted to a sign beam of the support mount of the fluid container retaining system.

FIG. 6 illustrates a perspective view of the sign 174 mounted to the sign beam 172 of the support mount 106 of the fluid container retaining system 100. After the support mount 106 is secured to the surface 178, a lower end of the sign 174 may be optionally inserted into and retained by the sign beam 172.

Figure 7:
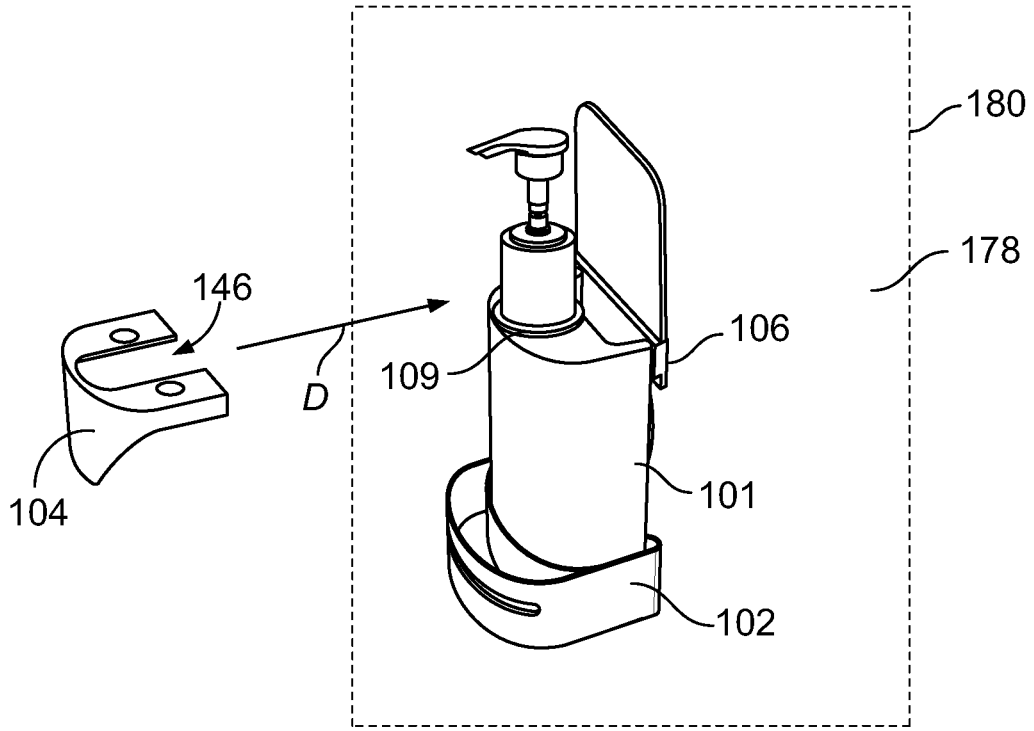
FIG. 7 illustrates a perspective view of the fluid container coupled to the support mount of the fluid container retaining system.

FIG. 7 illustrates a perspective view of the fluid container 101 coupled to the support mount 106 of the fluid container retaining system 100. The neck 109 of the fluid container 101 is aligned with the central recess 152 (shown in FIG. 3) of the support mount 106 and urged therein. Then, the cover 104 is aligned with an opposite side of the neck 109 and urged into the neck 109 in the direction of arrow D.

Figure 8:
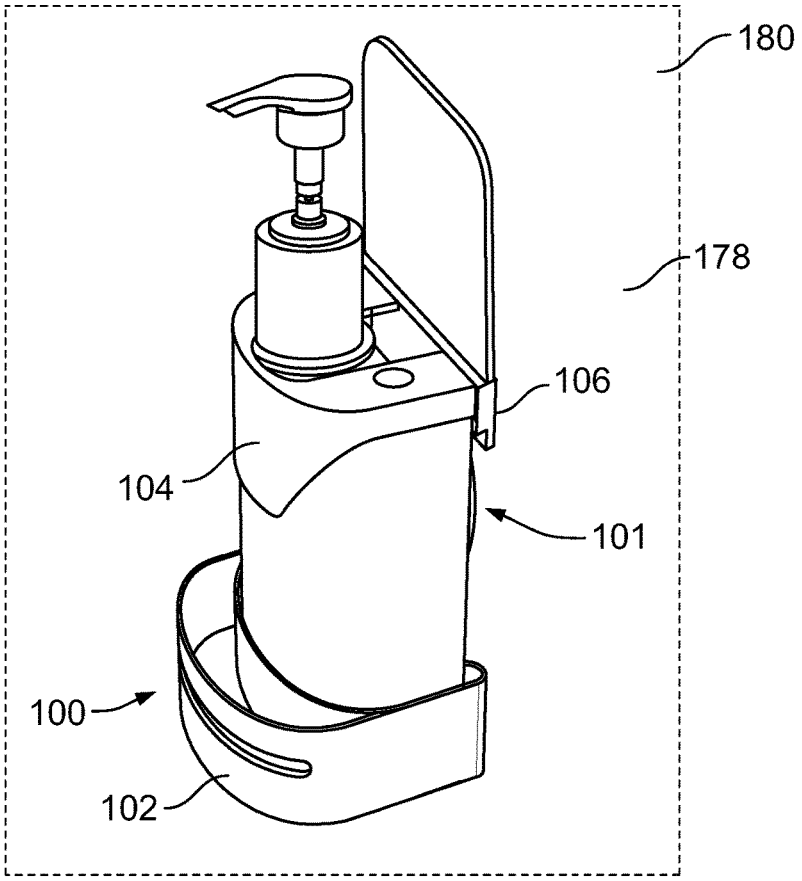
FIG. 8 illustrates a perspective view of the cover securing to the support mount of the fluid container retaining system.

FIG. 8 illustrates a perspective view of the cover 104 securing to the support mount 106 of the fluid container retaining system 100. The cover 104 is urged into the support mount 106 until the cover 104 snapably secures to the support mount 106, as described above. As such, the cover 104 and the support mount 106 trap the neck 109 therebetween, and securely constrain and retain the fluid container 101. The support mount 106 further secures the fluid container retaining system 100 and the fluid container 101 to the surface 178, such as by the securing assembly 112 (shown in FIG. 5).

Figure 9:
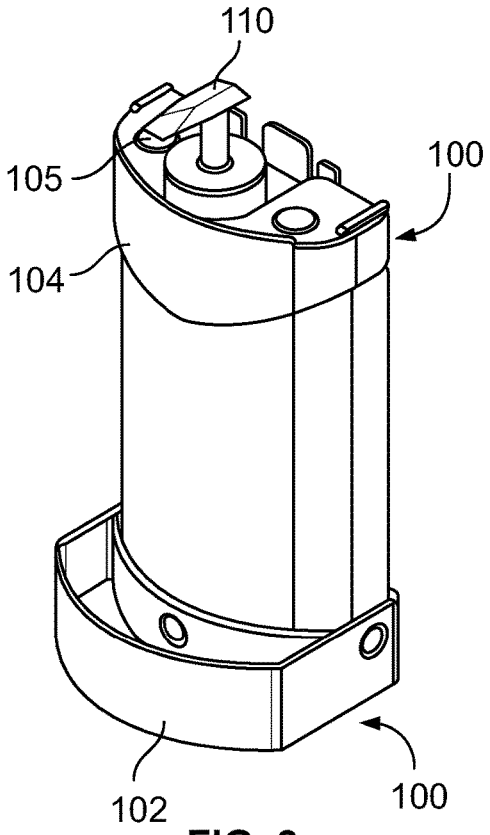
FIG. 9 illustrates a perspective front view of the fluid container retaining system that retains the fluid container, according to an embodiment of the present disclosure.
Figure 10:
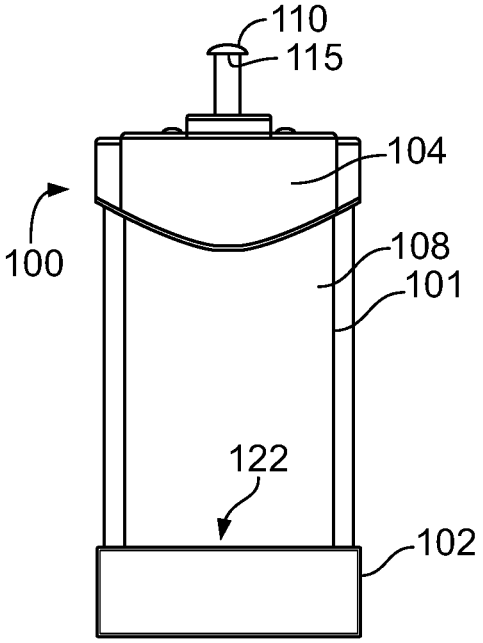
FIG. 10 illustrates a front view of the fluid container retaining system that retains the fluid container.
Figure 13:
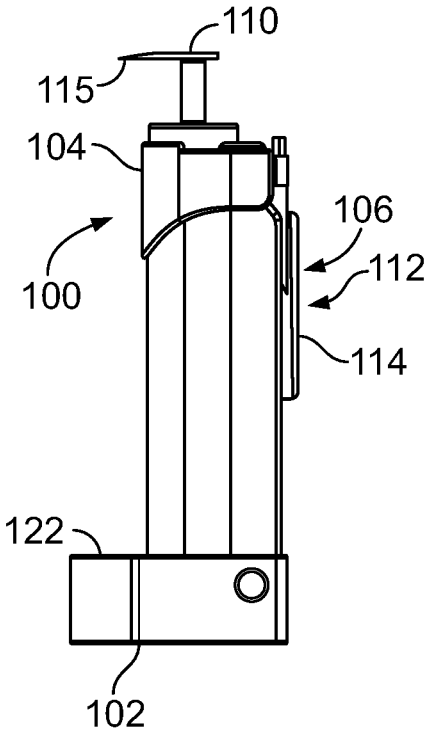
FIG. 13 illustrates a lateral view of the fluid container retaining system that retains the fluid container.
Figure 11:
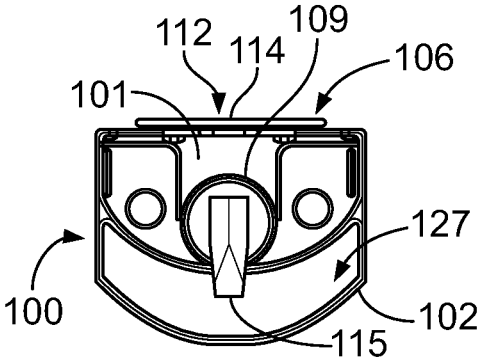
FIG. 11 illustrates a top view of the fluid container retaining system that retains the fluid container.
Figure 12:
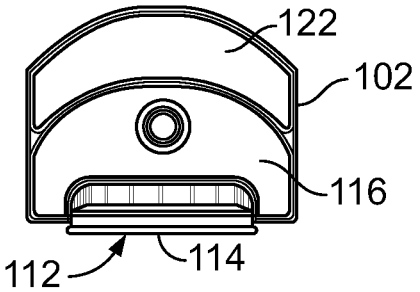
FIG. 12 illustrates a bottom view of the fluid container retaining system that retains the fluid container.
Figure 14:
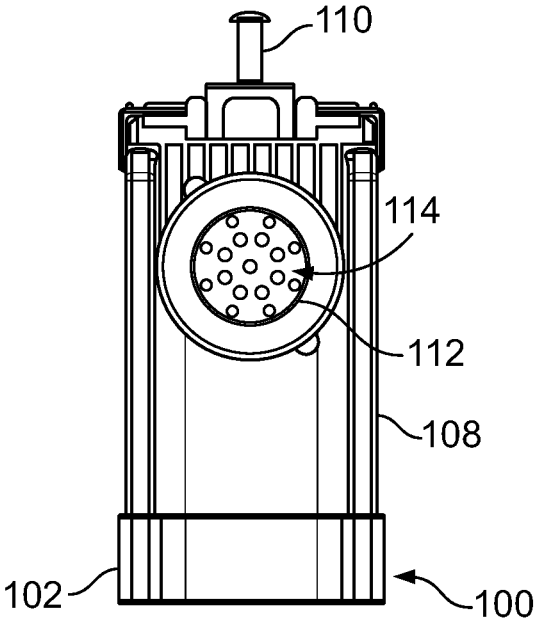
FIG. 14 illustrates a rear view of the fluid container retaining system that retains the fluid container.

FIG. 9 illustrates a perspective front view of the fluid container retaining system 100 that retains the fluid container 101, according to an embodiment of the present disclosure. FIG. 10 illustrates a front view of the fluid container retaining system 100 that retains the fluid container 101. FIG. 11 illustrates a top view of the fluid container retaining system 100 that retains the fluid container 101. FIG. 12 illustrates a bottom view of the fluid container retaining system 100 that retains the fluid container 101. FIG. 13 illustrates a lateral view of the fluid container retaining system 100 that retains the fluid container 101. FIG. 14 illustrates a rear view of the fluid container retaining system 100 that retains the fluid container 101.

Referring to FIGS. 9-14, the drip chamber 122 of the stand 102 is positioned below an outlet 115 of the pump 110. As such, the drip chamber 122 is able to catch and retain fluid that is inadvertently dispensed from the pump 110.

Figure 15:
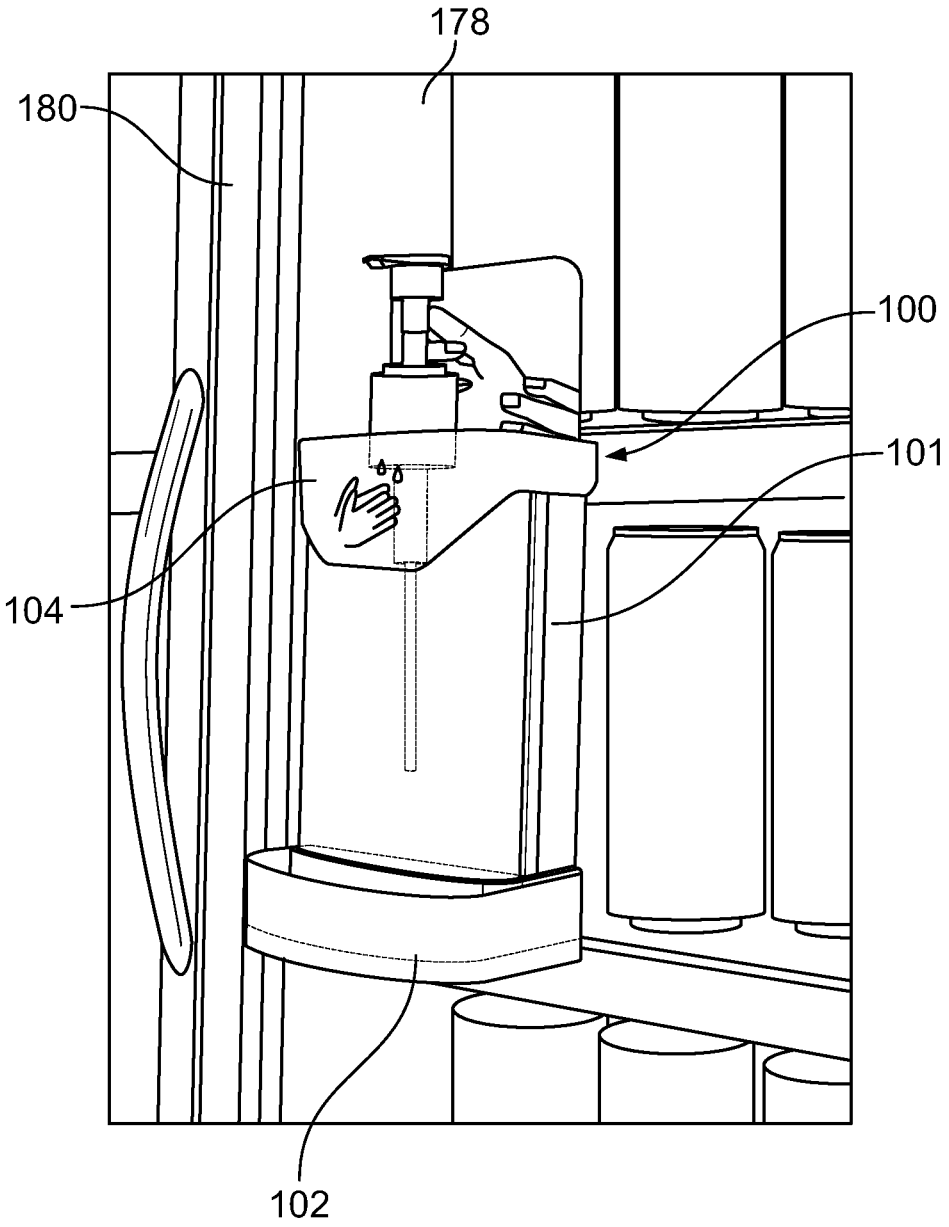
FIG. 15 illustrates a perspective front view of the fluid container retaining system securing the fluid container to a surface of a structure, according to an embodiment of the present disclosure.

FIG. 15 illustrates a perspective front view of the fluid container retaining system 100 securing the fluid container 101 to the surface 178 of the structure 180, according to an embodiment of the present disclosure. The structure 180 may be a refrigerated compartment. The surface 178 may be a glass door of the refrigerated compartment. The support mount 106 (shown in FIGS. 2 and 3, for example) secures the fluid container retaining system 100 and the fluid container 101 to the surface 178 by the suction cup 114 (shown in FIGS. 2 and 3, for example).

Figure 16:
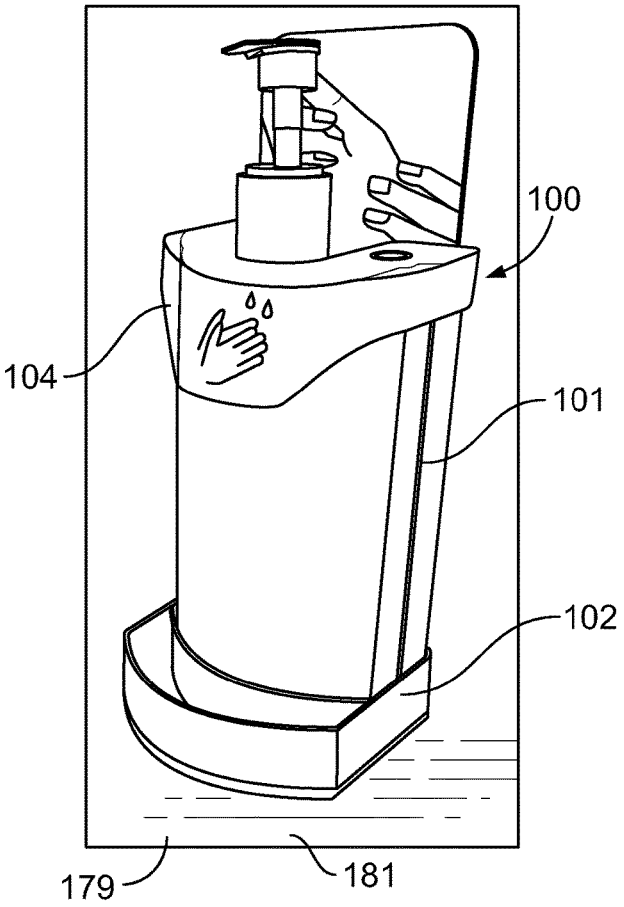
FIG. 16 illustrates a perspective front view of the fluid container retaining system mounting the fluid container on a surface of a structure, according to an embodiment of the present disclosure.

FIG. 16 illustrates a perspective front view of the fluid container retaining system 100 mounting the fluid container 101 on a surface 179 of a structure 181, according to an embodiment of the present disclosure. The structure 181 may be a counter top, shelf, or the like, and the surface 179 may be a flat level surface thereof. The stand 102 may stably support the fluid container 101 on the surface 179.

Figure 17:
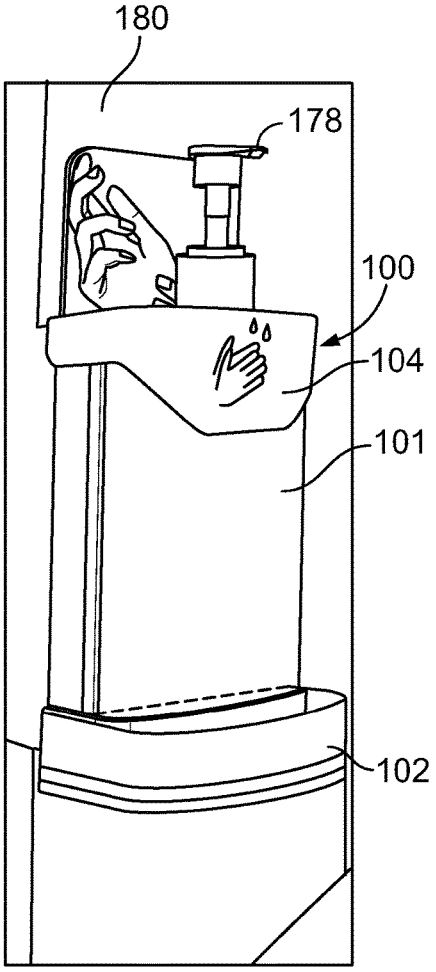
FIG. 17 illustrates a perspective front view of the fluid container retaining system securing the fluid container to a surface of a structure, according to an embodiment of the present disclosure.

FIG. 17 illustrates a perspective front view of the fluid container retaining system 100 securing the fluid container 101 to the surface 178 of the structure 180, according to an embodiment of the present disclosure. Referring to FIGS. 3 and 17, the adhesive disc 170 may be used to adhesively secure the fluid container retaining system 100, and therefore the fluid container 101, to the structure 180 if the suction cup 114 is not able to adequately secure to the surface 178.

Figure 18:
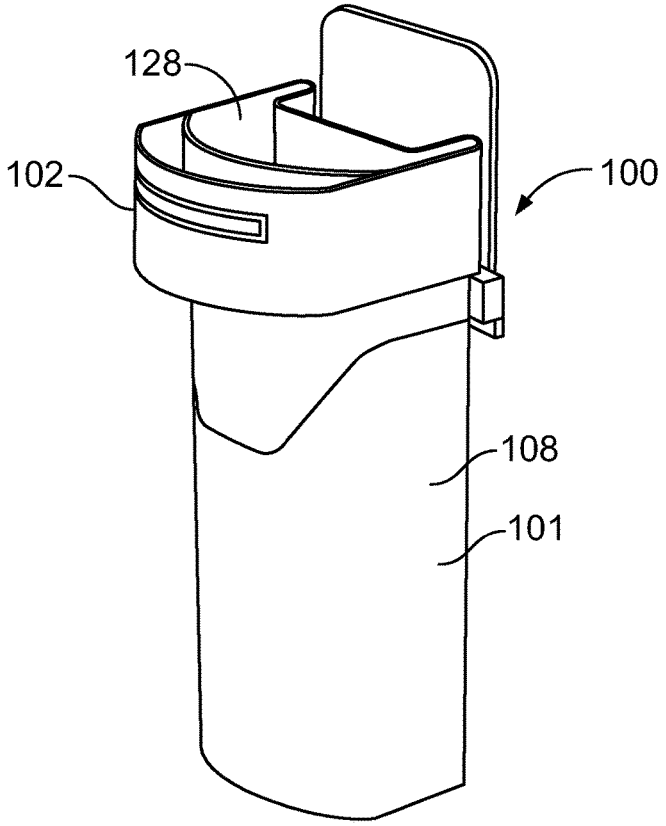
FIG. 18 illustrates a perspective front view of a stand of the fluid container retaining system mounted over a bottle of the fluid container, according to an embodiment of the present disclosure.
Figure 19:
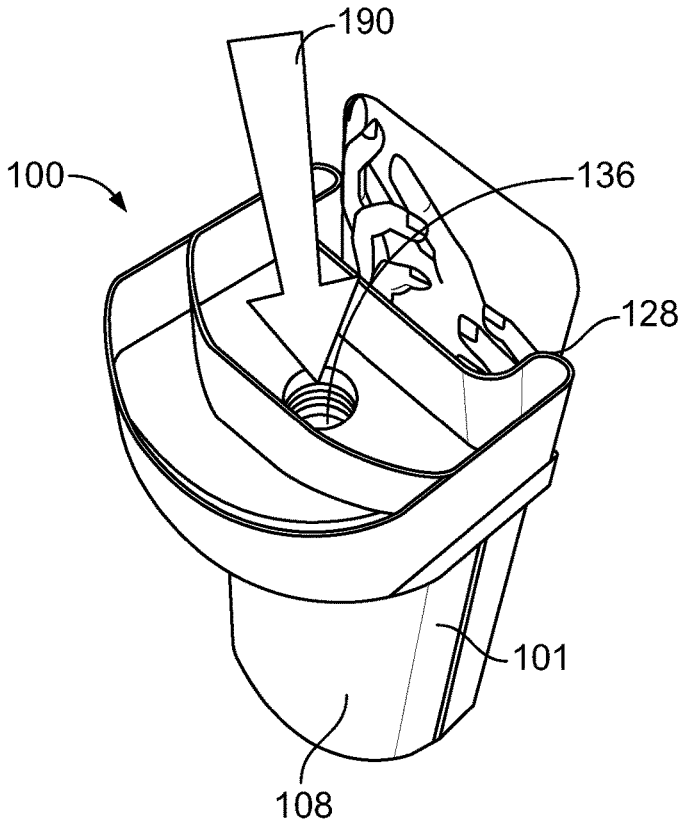
FIG. 19 illustrates a perspective top view of the stand of the fluid container retaining system mounted over the bottle of the fluid container.

FIG. 18 illustrates a perspective front view of the stand 102 of the fluid container retaining system 100 mounted over the bottle 108 of the fluid container 101, according to an embodiment of the present disclosure. FIG. 19 illustrates a perspective top view of the stand 102 of the fluid container retaining system 100 mounted over the bottle 108 of the fluid container 101.

Referring to FIGS. 3, 18, and 19, in at least one embodiment, the opening 136 is formed through the base 116 and provides a passage between the bottle retaining chamber 128 and out of the stand 102 through the opening 136. The stand 102 may be mounted onto the neck 109 of the bottle 108 when the pump 110 is removed such that the opening 136 is axially aligned with the fluid passage 111 defined by the neck 109. In this manner, the stand 102 may optionally also be used as a filling device, such as a funnel, to refill the bottle 108 with fluid 190, such as hand sanitizer.

Referring to FIGS. 1-19, the fluid container retaining system 100 provides a consistent and systematic approach for hand sanitation, such as when the fluid container 101 retains hand sanitizer. The fluid container retaining system 100 can secure bottles of hand sanitizer at key locations within an establishment, such as at entry doors, cooler doors, food service areas, restrooms, checkout counters, and the like. The fluid container retaining system 100 is able to secure the fluid container to glass doors (such as via the suction cup 114), wall surfaces (such as via the adhesive disc 170), and/or on top of shelves and counters (such as via the stand 102). The cover 104 and the support mount 106 securely constrain, retain, and trap the neck 109 therebetween, and deter inadvertent removal of the fluid container 101 from the fluid container retaining system 100. Further, the stand 102 provides the drip chamber 122, which catches excess fluid. Additionally, the stand 102 can be used as a refilling device.

Figure 20:
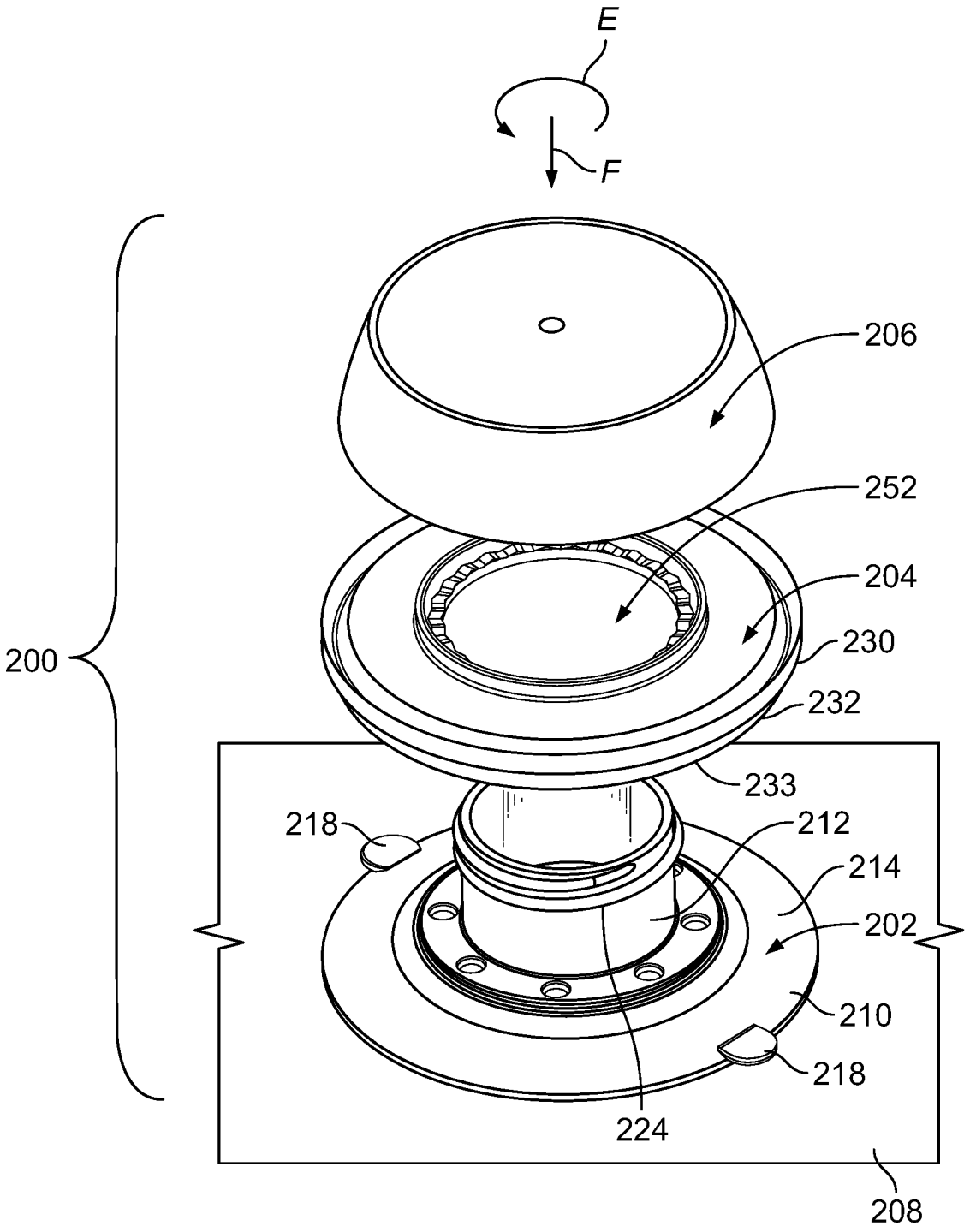
FIG. 20 illustrates a perspective exploded view of a securing assembly, according to an embodiment of the present disclosure.

FIG. 20 illustrates a perspective exploded view of a securing assembly 200, according to an embodiment of the present disclosure. The securing assembly 112 shown in FIGS. 2 and 3 may include components of the securing assembly 200. For example, in at least one embodiment, the securing rim 160 shown and described with respect to FIG. 3 may include a locking member, as described herein.

The securing assembly 200 includes a suction cup 202 (such as the suction cup 114 shown in FIGS. 2 and 3), a locking member, such as a locking ring 204 (such as may be part of the securing rim 160 shown in FIG. 3), and a suction securing nut 206 (such as the suction securing nut 166 shown in FIG. 3). The suction cup 202 is configured to directly couple to a structure 208 (for example, a glass door or window). The locking ring 204 couples to the suction cup 202. The suction securing nut 206 couples to the locking ring 204 and the suction cup 202. Optionally, the locking member may be a non-ring like structure, such as one or more panels, or the like.

As shown, the locking ring 204 is disposed between the suction cup 202 and the suction securing nut 206. A portion of the locking ring 204 (such as a beveled rim 232) is configured to be urged into a portion of the suction securing nut 206 (such as an annular lip 214 of a suctioning base 210 as the suction securing nut 206 is tightened in relation to the suction cup 202. In at least one embodiment, an intermediate structure, such as a portion of a bracket or the like, may be disposed between the suction securing nut 206 and the locking ring 204, and/or the locking ring 204 and the suction cup 202.

Figure 21:
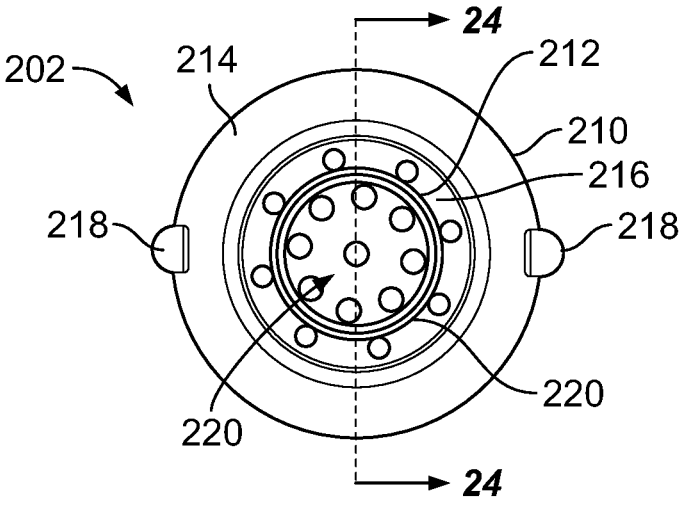
FIG. 21 illustrates a top view of a suction cup, according to an embodiment of the present disclosure.
Figure 22:
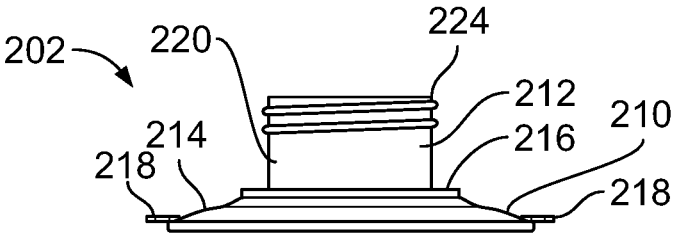
FIG. 22 illustrates a lateral view of the suction cup.
Figure 23:
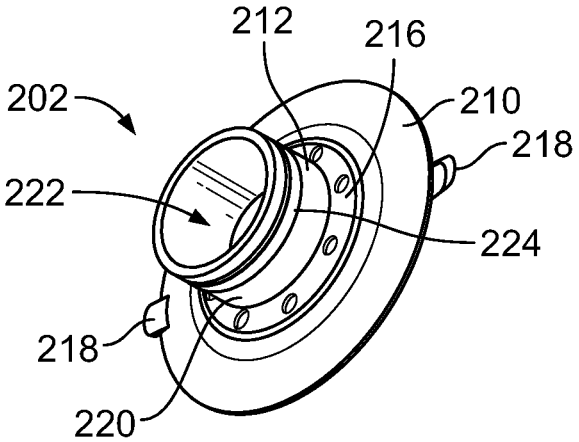
FIG. 23 illustrates a perspective top view of the suction cup.
Figure 24:
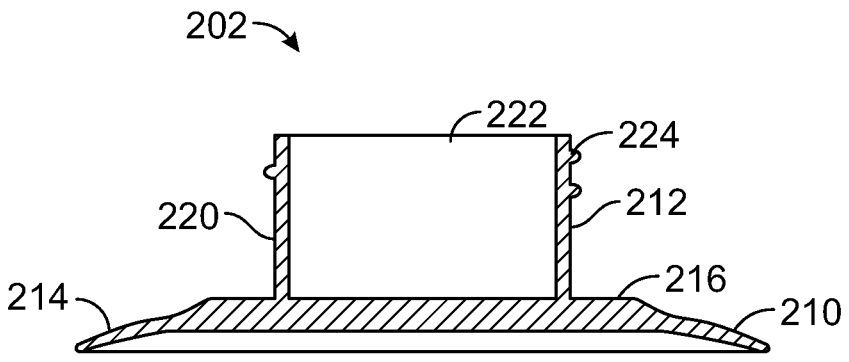
FIG. 24 illustrates a cross-sectional view of the suction cup through line 24-24 of FIG. 18.
Figure 25:
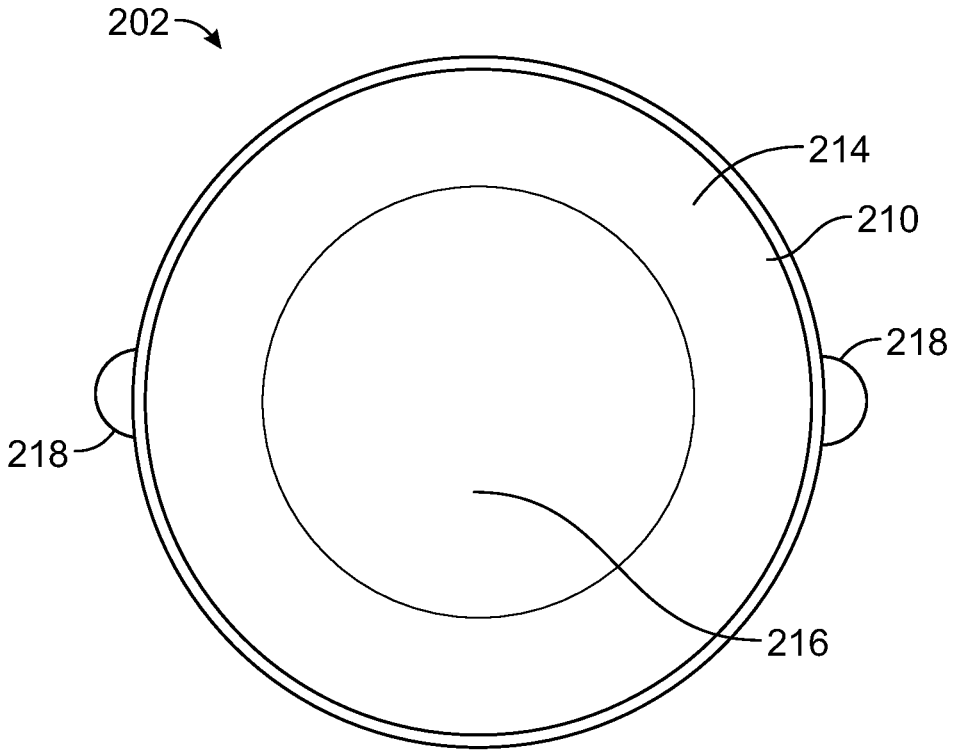
FIG. 25 illustrates a bottom view of the suction cup.

FIG. 21 illustrates a top view of the suction cup 202, according to an embodiment of the present disclosure. FIG. 22 illustrates a lateral view of the suction cup 202. FIG. 23 illustrates a perspective top view of the suction cup 202. FIG. 24 illustrates a cross-sectional view of the suction cup 202 through line 24-24 of FIG. 21. FIG. 25 illustrates a bottom view of the suction cup 202.

Referring to FIGS. 21-25, the suction cup 202 includes a suctioning base 210 integrally connected to a stem 212 (such as the stem 164 shown in FIG. 3) extending upwardly from the suctioning base 210. The suctioning base 210 may include an outer annular lip 214 surrounding a flattened interior circular body 216. Pull tabs 218 may extend radially outward from outer edges of the annular lip 214. The pull tabs 218 are configured to be pulled outwardly from a surface to remove the suction cup 202 therefrom.

The stem 212 includes a cylindrical shaft 220 surrounding a central channel 222 that extends to the suctioning base 210. An outer surface of the shaft 220 may include threads 224 that are configured to threadably engage interior threads of the suction securing nut 206 (shown in FIG. 20).

Figure 26:
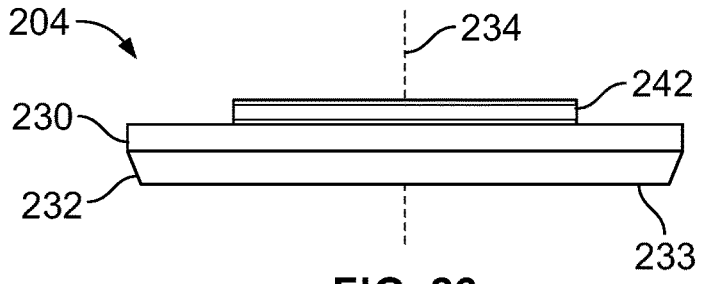
FIG. 26 illustrates a lateral view of a locking ring, according to an embodiment of the present disclosure.
Figure 27:
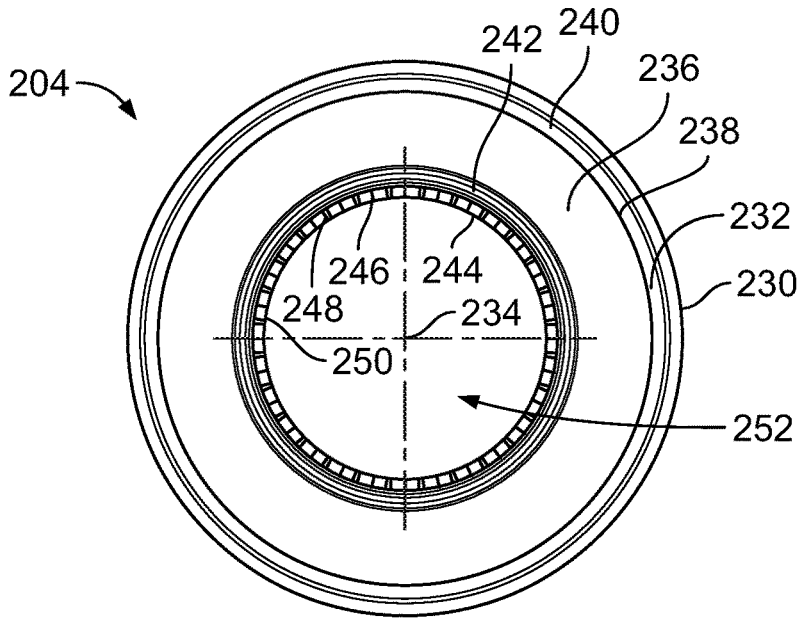
FIG. 27 illustrates a top view of the locking ring.
Figure 28:
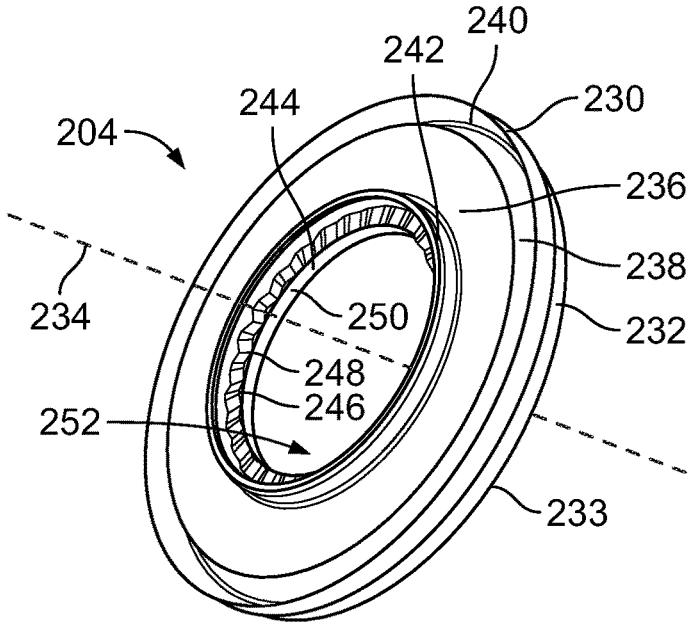
FIG. 28 illustrates a perspective top lateral view of the locking ring.

FIG. 26 illustrates a lateral view of the locking ring 204, according to an embodiment of the present disclosure. FIG. 27 illustrates a top view of the locking ring 204. FIG. 28 illustrates a perspective top lateral view of the locking ring 204.

Referring to FIGS. 26-28, the locking ring 204 includes an annular outer rim 230 and a beveled rim 232 extending downwardly from the outer rim 230. The beveled rim 232 inwardly cants from the outer rim 230 towards a central axis 234 of the locking ring 204. The inward cant angle of the beveled rim 232 may be greater or less than shown.

An inboard support base 236 connects to an inner diameter of the beveled rim 232 through an interior rim 238. The interior rim 238 may be coaxial with the outer rim 230. An interior groove 240 is formed between the outer rim 230, the beveled rim 232, and the interior rim 238.

An interior diameter of the inboard support base 236 connects to an interior upstanding annular wall 242, which upwardly extends from the support base 236. An interior ledge 244 inwardly extends from the annular wall 242 towards and about the central axis 234. The interior ledge 244 may be within one or more planes that are parallel to a plane of an upper surface of the support base 236. The interior ledge 244 may be serrated, and include a plurality of alternating peaks or teeth 246 and valleys or recesses 248 extending therearound. An interior edge 250 defines an internal circular passage 252. Alternatively, the interior ledge 244 may be smooth and flat, instead of serrated.

Referring to FIGS. 20-28, the locking ring 204 fits over the suction cup 202, such that the stem 212 passes through the passage 252 of the locking ring 204. A bottom edge 233 of the beveled rim 232 abuts into an upper surface of the annular lip 214 of the suctioning base 210.

Figure 29:
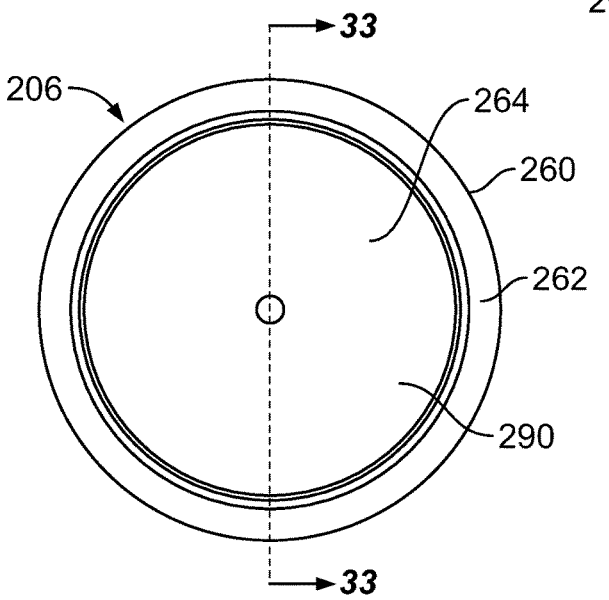
FIG. 29 illustrates a top view of a suction securing nut, according to an embodiment of the present disclosure.
Figure 31:
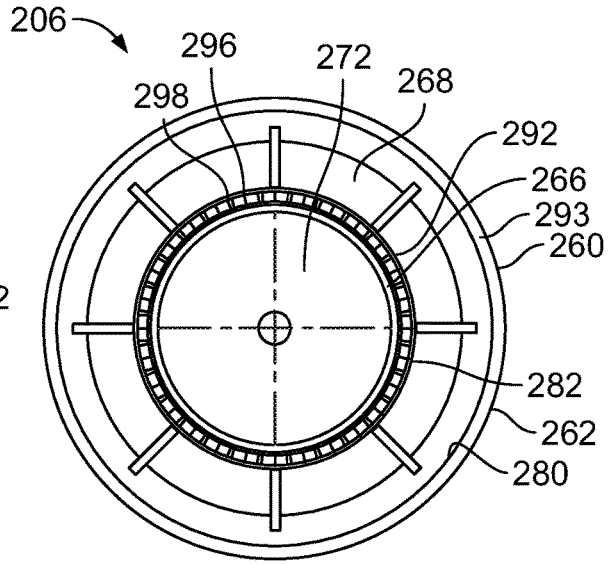
FIG. 31 illustrates a bottom view of the suction securing nut.
Figure 30:
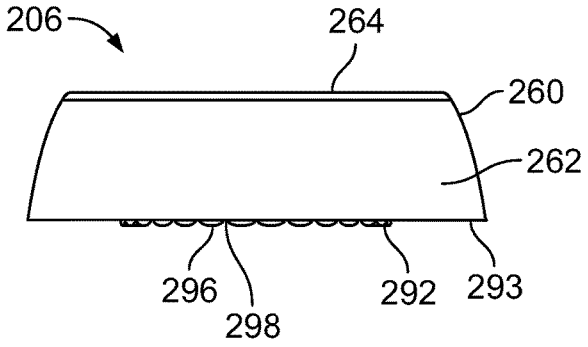
FIG. 30 illustrates a lateral view of the suction securing nut.
Figure 32:
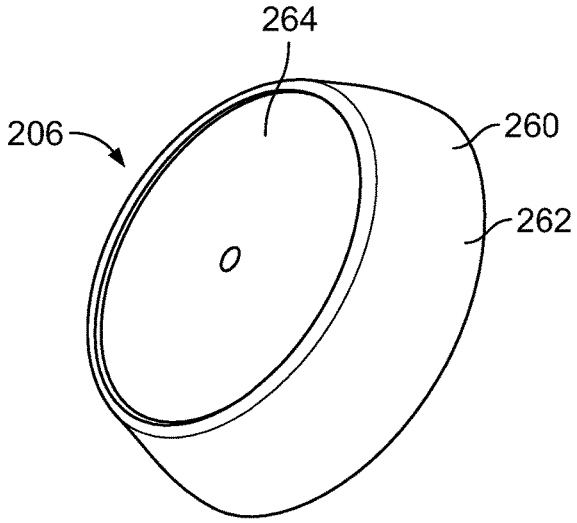
FIG. 32 illustrates a perspective top view of the suction securing nut.
Figure 33:
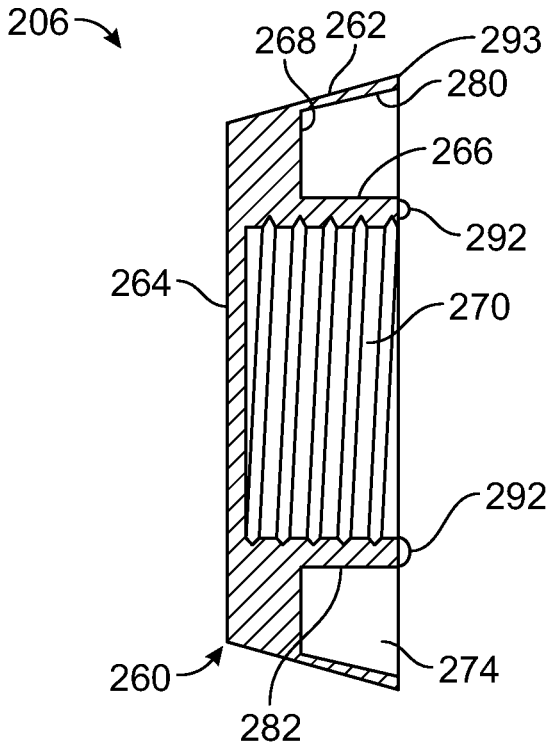
FIG. 33 illustrates a cross-sectional view of the suction securing nut through line 33-33 of FIG. 29.

FIG. 29 illustrates a top view of the suction securing nut 206, according to an embodiment of the present disclosure. FIG. 30 illustrates a lateral view of the suction securing nut 206. FIG. 31 illustrates a bottom view of the suction securing nut 206. FIG. 32 illustrates a perspective top view of the suction securing nut 206. FIG. 33 illustrates a cross-sectional view of the suction securing nut 206 through line 33-33 of FIG. 29.

Referring to FIGS. 29-33, the suction securing nut 206 includes an outer shroud 260 having an outer circumferential wall 262 connected to an outer cap 264. An interior connecting tube 266 extends inwardly from an interior surface 268 of the cap 264. The connecting tube 266 includes an interior threaded surface 270 surrounding a central chamber 272. An outer channel 274 is defined between an interior surface 280 of the wall 262 and an outer surface 282 of the connecting tube 266. Alternatively, the stem 212 of the suction cup 202 may include an interior threaded surface that threadably receives and engages an outer threaded surface of the connecting tube 266 of the suction securing nut 206.

An outer surface 290 of the cap 264 may be configured to support one or more graphics, such as advertisements, information, or the like. For example, a graphics display may be formed on the outer surface 290 of the cap 264. In at least one embodiment, graphics displays may be directly formed, etched, written, adhesively secured, and/or the like onto the outer surface 290 of the cap 264. In at least one other embodiment, a clear pocket may be formed over the outer surface 290, and the graphics display may be formed on a sheet of plastic, paper, or the like that is inserted between the outer surface 290 and an interior surface of the clear pocket.

As shown, a lower edge 292 of the interior connecting tube 266 may extend below a lower surface 293 of the outer circumferential wall 262. The lower surface 293 may be serrated and include a plurality of alternating peaks or teeth 296 and valleys or recesses 298 extending therearound. The lower surface 293 of the interior connecting tube 266 is configured to couple to the interior ledge 244 of the locking ring 204 (shown in FIGS. 26-28), such that the peaks 296 and valleys 298 of the connecting tube 266 engage the peaks 246 and valleys 248 of the interior ledge 244 of the locking ring 204, thereby forcing the locking ring 204 into the suction cup 202. Alternatively, the lower surface 293 may be smooth and flat, instead of serrated.

Figure 34:
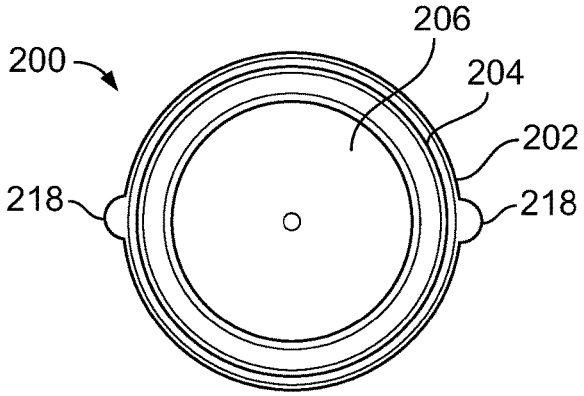
FIG. 34 illustrates a top view of the securing assembly.
Figure 36:
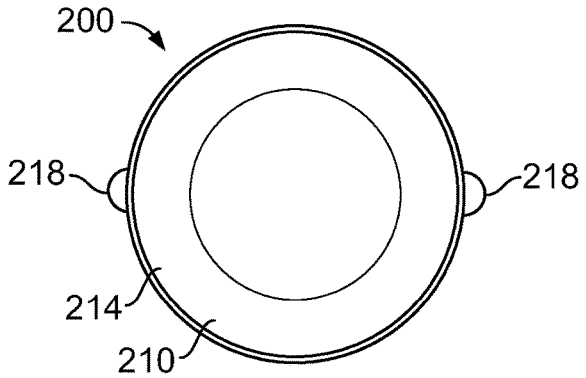
FIG. 36 illustrates a bottom view of the securing assembly.
Figure 35:
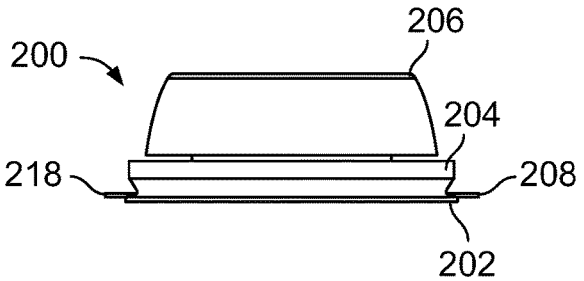
FIG. 35 illustrates a lateral view of the securing assembly.
Figure 37:
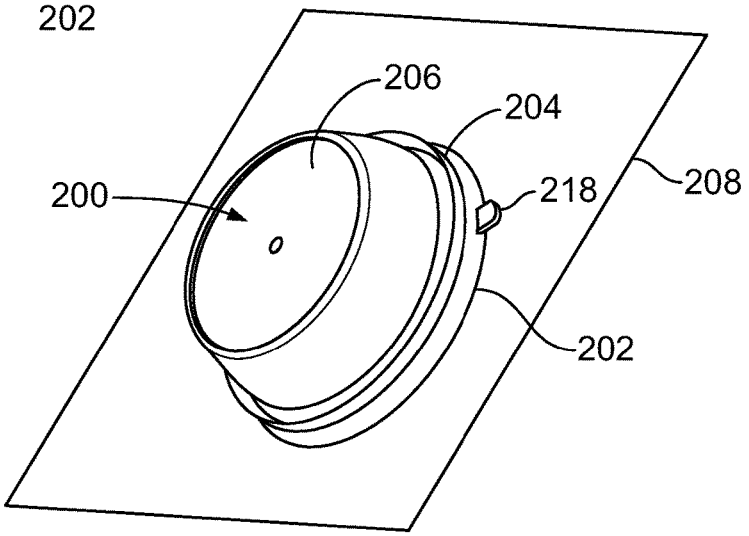
FIG. 37 illustrates a perspective view of the securing assembly secured to a structure, according to an embodiment of the present disclosure.

FIG. 34 illustrates a top view of the securing assembly 200. FIG. 35 illustrates a lateral view of the securing assembly 200. FIG. 36 illustrates a bottom view of the securing assembly 200. FIG. 37 illustrates a perspective view of the securing assembly 200 secured to the structure 208.

Referring to FIGS. 20-37, after the locking ring 204 has been coupled to the suction cup 202, as described above, the suction securing nut 206 is axially aligned over the stem 212 of the suction cup 202. The suction securing nut 206 is then urged onto the suction cup 202 such that the interior threaded surface 270 of the connecting tube 266 threadably engages the threads 224 of the stem 212. The suction securing nut 206 is then rotated in a securing direction E relative to the suction cup 202. As the suction securing nut 206 continues to be threaded in the securing direction E, the lower ledge 292 of the interior connecting tube 266 is forced into the interior ledge 244 of the locking ring 204, thereby forcing the locking ring downwardly towards the suction cup 202 in the direction of arrow F. The engagement of the alternating peaks and valleys of the lower ledge 292 and the interior ledge 244 may axially secure the suction securing nut 206 with respect to the locking ring 204 (such as via the peaks 296 of the lower ledge 292 mating into reciprocal valleys 248 of the interior ledge 244, and the peaks 246 of the interior ledge 244 mating into reciprocal valleys 298 of the lower ledge 292), so as to reduce slippage therebetween. As the suction securing nut 206 is tightened with respect to the stem 212, the bottom edge 233 of the beveled rim 232 of the locking ring 204 is forced into the annular lip 214 of the suctioning base 210, which causes the annular lip 214 to flatten. The flattening of the annular lip 214 provides a vacuum between the structure 208 and the suction cup 202. The locking ring 204 locks the suction cup 202 to the structure 208 via engagement with the suction securing nut 206. The suction securing nut 206 forces the locking ring 204 into the annular lip 214, flattening the annular lip 214 and forming a vacuum between the suction cup 202 and the structure 208, which forms a robust, strong, and reliable connection therebetween.

In order to remove the securing assembly 200 from the structure 208, the suction securing nut 206 is rotated in a direction that is opposite to the securing direction E (optionally, the securing direction E and the opposite direction may be reversed). As the suction securing nut 206 disengages from the stem 212 of the suction cup 202, the suction securing nut 206 disengages from the locking ring 204. As such, the force exerted by the locking ring 204 into the annular lip 214 decreases. The pull tabs 218 may then be pulled away from the structure 208, thereby removing the suction cup 202 therefrom.

As described herein, the suction cup 202, the locking ring 204, and the suction securing nut 206 may form the securing assembly 200. As the connecting tube 266 is rotated into a securing position with the stem 212, the locking ring 204 is forced into the annular lip 214 of the suctioning base 210, which greatly increases the suctioning force exerted by the suctioning base 210 (such as by drawing air out of the interface between the structure 208 and the suctioning base 210 to create a vacuum), thereby increasing the securing force between the securing assembly 200 and the surface of the structure 208. It has been found that by including the locking ring 204 in the securing assembly 200, increased suction retaining force is achieved with the surface of the component, such as a glass surface of a refrigerated compartment door. The resulting suctioning force achieved by operation of the locking ring 204 with the suction securing nut 206 and the suction cup 202 greatly exceeds that of a standard suction cup that is merely linearly pressed into a surface of a component.

Figure 38:
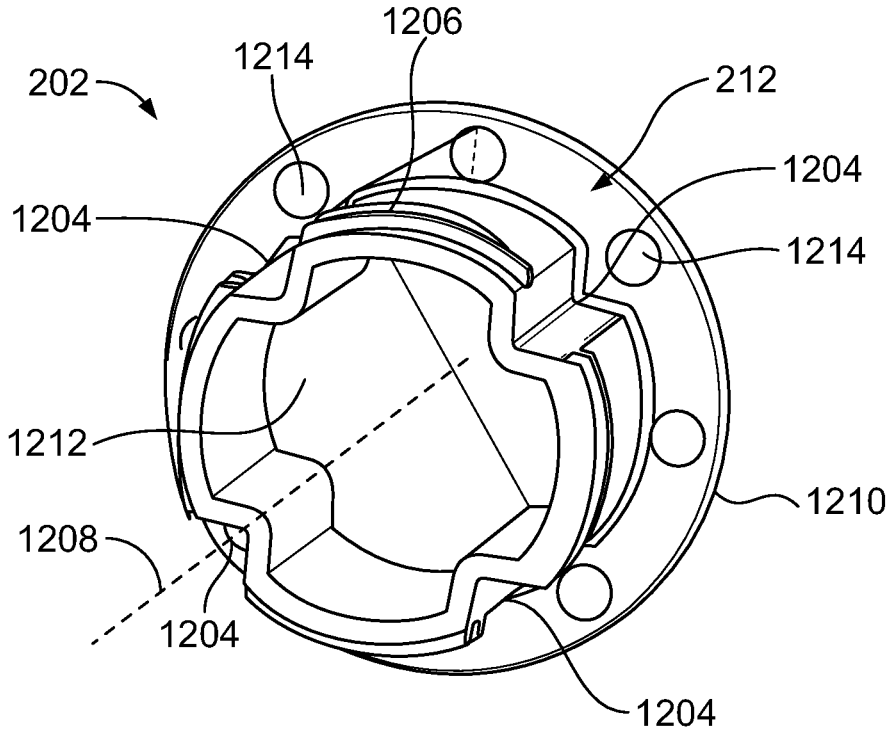
FIG. 38 illustrates a perspective top view of a stem of a suction cup, according to an embodiment of the present disclosure.

FIG. 38 illustrates a perspective top view of a stem 212 of a suction cup 202, according to an embodiment of the present disclosure. Keying members 1204 may be formed through the stem 212. Outer surfaces of the stem 212 may include threads 1206, as described above. The keying members 1204 may be channels, indentations, divots, recessed areas, notches, slots, or the like, formed in an outer surface of the stem 212. Each keying member 1204 may be formed along a height of the stem 212 and may be parallel to a central axis 1208 of the stem 212. As shown, four evenly-spaced keying members 1204 are shown. Alternatively, more or less keying members than shown may be used.

The keying members 1204 provide alignment keys that are configured to receive reciprocal structures formed on a component, such as an engagement protuberance, an accessory, bracket or the like, in order to maintain the component in a desired position. For example, support mounts may include inwardly directed tabs extending into the passages. Any of the embodiments described herein may include the keying members 1204. Optionally, embodiments may not include the keying members 1204.

Additionally, a flange 1210 radially extends from a base 1212 of the stem 212. The flange 1210 may include one or more holes 1214 formed therethrough. More or less holes than shown may be used. A suctioning base (such as the suctioning base 110 may be secured over or otherwise onto the flange 1210. The holes 1214 are configured to allow the flexible material of the suctioning base to flow around and through the flange 1210, thereby providing an increased retaining interface, as well as providing a greater degree of flexibility to the suctioning base. Any of the embodiments described herein may include the holes 1214. Optionally, embodiments may not include the holes 1214.

Figure 39:
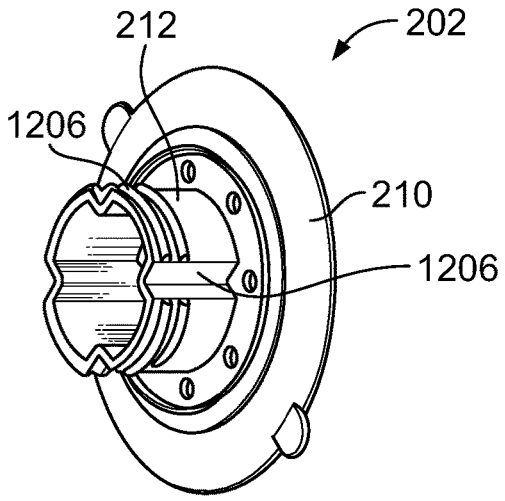
FIG. 39 illustrates a perspective view of a suction cup, according to an embodiment of the present disclosure.
Figure 40:
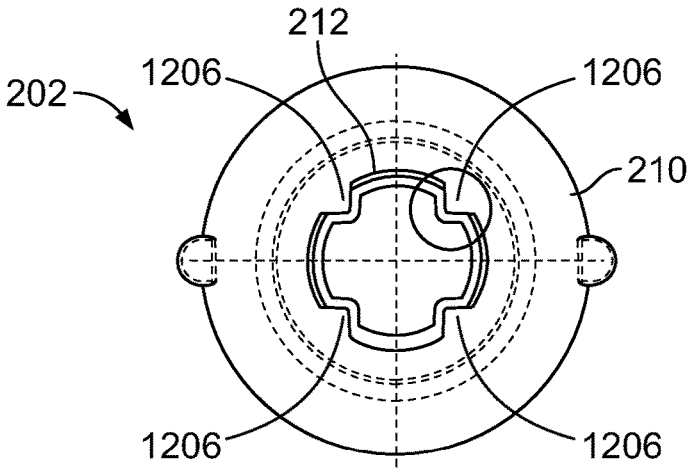
FIG. 40 illustrates a top view of a suction cup, according to an embodiment of the present disclosure.

FIG. 39 illustrates a perspective view of the suction cup 202, according to an embodiment of the present disclosure. FIG. 40 illustrates a top view of the suction cup 202. Referring to FIGS. 39 and 40, as shown, the suctioning base 210 is secured to the stem 212. The threads 1206 are formed on an outer surface of the stem 212, while the keying members 1204 are formed through portions of the stem 212.

Figure 41:
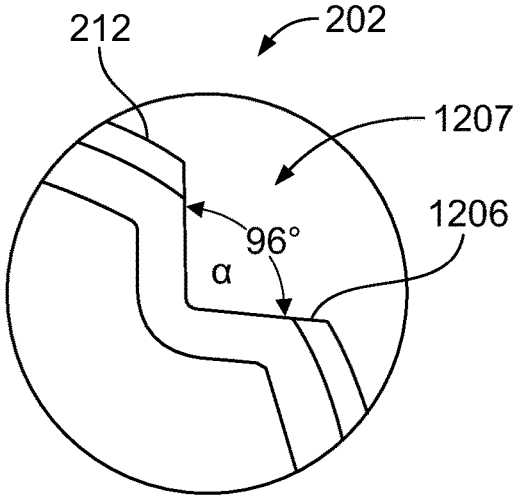
FIG. 41 illustrates a top view of a keying member of a suction cup, according to an embodiment of the present disclosure.

FIG. 41 illustrates a top view of a keying member 1206 of the suction cup 202, according to an embodiment of the present disclosure. As shown, the keying member 1206 may be an indented feature within the outer wall of the stem 212. The indentation 1207 may form an angle $\alpha$ that may conform to an outer surface of a mounting bracket of a component. For example, the angle $\alpha$ may be 96 degrees. Alternatively, the angle $\alpha$ may be greater or less than 96 degrees.

Figure 42:
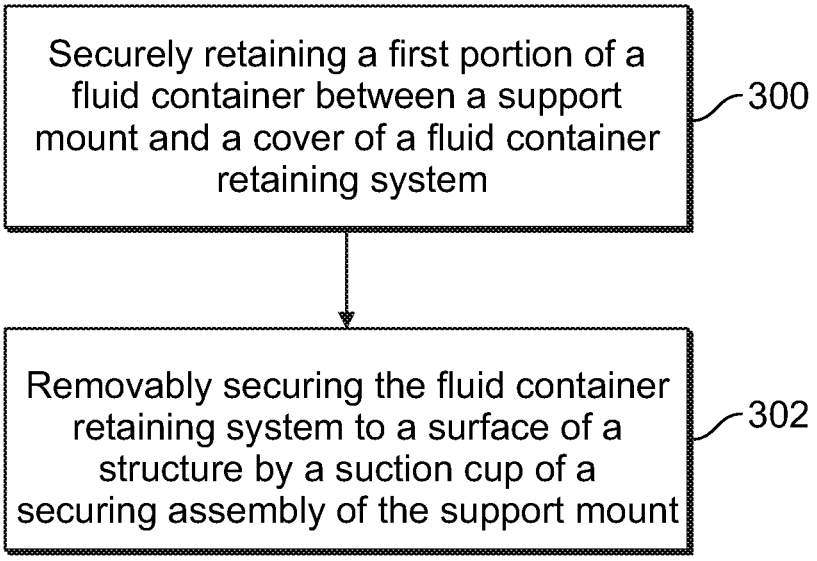
FIG. 42 illustrates a flow chart of a method, according to an embodiment of the present disclosure.

FIG. 42 illustrates a flow chart of a method, according to an embodiment of the present disclosure. The method includes securely retaining, at 300, a first portion of a fluid container between a support mount and a cover of a fluid container retaining system; and removably securing, at 302, the fluid container retaining system to a surface of a structure by a suction cup of a securing assembly of the support mount.

In at least one embodiment, the method also includes securing a second portion of the fluid container to a stand of the fluid container retaining system. The method may also include catching, by a drip chamber of the stand, fluid dispensed from a pump of the fluid container, and retaining, by a bottle retaining chamber separated from the drip chamber, the second portion of the fluid container.

In at least one embodiment, the method also includes supporting a base of the stand further comprises on a level surface.

In at least one embodiment, the method also includes mounting the stand over a portion of the fluid container, and filling the fluid container through an opening of the stand.

In at least one embodiment, the method also includes snapably securing the cover and the support mount together to trap the first portion of the fluid container therebetween.

In at least one embodiment, the method also includes securing and adhesive disc to the suction cup.

In at least one embodiment, the method also includes removably retaining, by the support mount, a sign (which may includes graphics, text, or the like, such as an advertisement or health advisory message).

In at least one embodiment, the method also includes supporting the fluid container above a floor with a floor stand.

Figure 43:
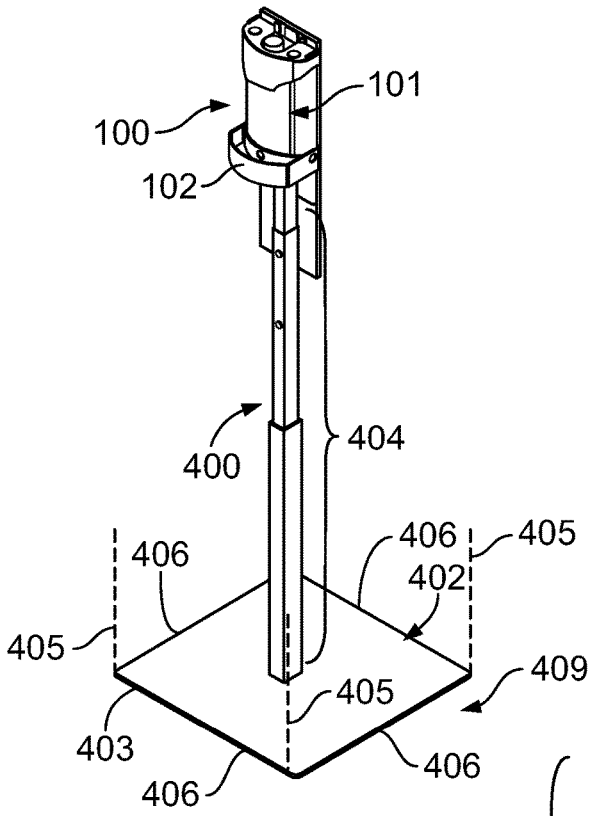
FIG. 43 illustrates a perspective front view of a fluid container retaining system including a floor stand, according to an embodiment of the present disclosure.

FIG. 43 illustrates a perspective front view of the fluid container retaining system 100 including a floor stand 400, according to an embodiment of the present disclosure. In at least one embodiment, instead of (or in addition to) being secured to a surface of a component with a suction cup, the fluid container retaining system 100 may include the floor stand 400, which allows the fluid container retaining system 100 to be supported by a floor, for example. The floor stand 400 may be selectively coupled to and removed from the stand 102, as desired.

The floor stand 400 includes a floor mount 402. An extension beam 404 upwardly extends from the floor mount 402. As shown, the floor mount 402 includes a flat, planar mat 403, which may be formed of metal, and/or plastic. The mat 403 may have a an overall axial envelope 405 in relation to an outer perimeter 406 (and width, diameter, and/or the like in relation to the outer perimeter 406) that is greater than that of the base 102. For example, the axial envelope 405 of the mat 403 may be at least two times that of the base 102, in order to provide a stable mounting platform for the fluid container retaining system 100.

In at least one embodiment, the extension beam 404 may be a single, non-adjustable piece. In at least one other embodiment, the extension beam 404 includes one or more segments. In at least one embodiment, at least portion of the segments may be adjusted relative to one another to adjust an overall height of the fluid container retaining system 100.

Figure 44:
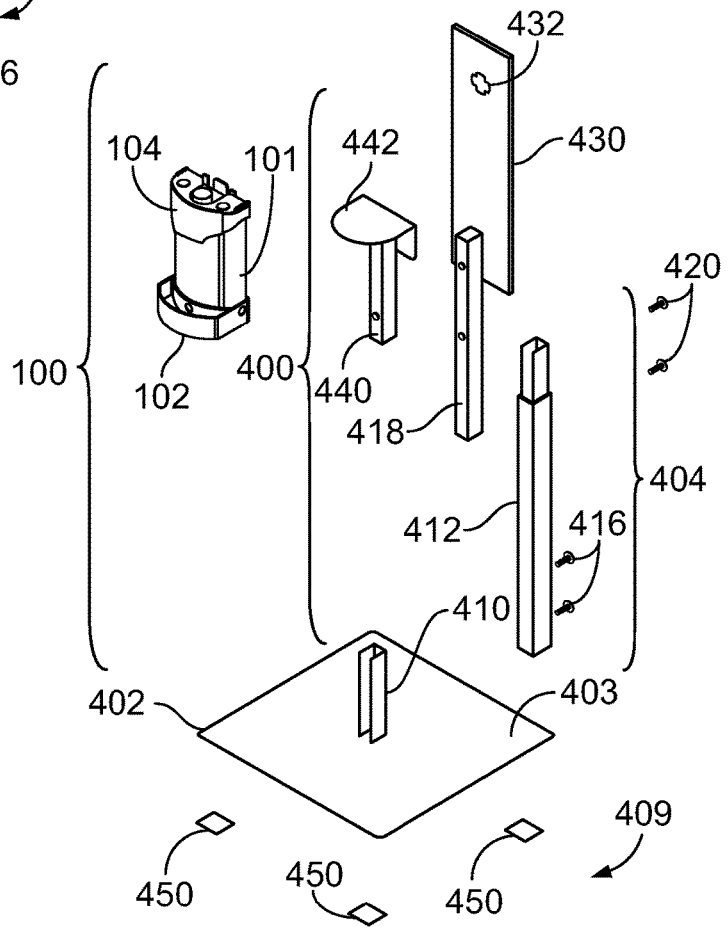
FIG. 44 illustrates a perspective exploded view of the floor stand of the fluid container retaining system of FIG. 43.

FIG. 44 illustrates a perspective exploded view of the floor stand 400 of the fluid container retaining system 100 of FIG. 43. In at least one embodiment, the extension beam 404 includes a first segment 410 upwardly extending from the mat 403, such upwardly from a center of the mat 403. A second segment 412 mates with the first segment 410 and may be secured thereto via one or more fasteners 416 (such as fasteners or bolts). The fasteners 416 may be configured to mate with a plurality of holes formed through the first segment 410 and the second segment 412 to selectively adjust a height of the second segment 412 in relation to the first segment 410.

Similarly, a third segment 418 mates with the second segment 410 (opposite from the first segment 410). One or more fasteners 420 may be used to secure the third segment 418 to the second segment 412. Further, the fasteners 420 may be configured to mate with a plurality of holes formed through the second segment 412 and the third segment 418 to selectively adjust a height of the third segment 418 in relation to the second segment 412.

A backing plate 430 is secured to the third segment 418. The backing plate 430 may be configured to extend above and/or below the fluid container 101. The backing plate 430 includes a passage 432 that is configured to receive a portion of the securing assembly 112 (such as shown and described with respect to FIGS. 2-7, for example). The securing assembly 112 can include the suction cup. Optionally, the suction cup can be removed from the securing assembly 112, as the fluid container retaining system 100 may be mounted on the floor via the floor stand 400 instead of being secured to a surface of a component via a suction cup.

The extension beam 440 may also include a fourth segment 440 that secures to the third segment 418, such as through one or more fasteners 420. The fourth segment 410 may be adjusted relative to the third segment 418. A platform 442 is secured to an upper end of the fourth segment 410. The base 102 may be supported on the platform 402. The cover 104 and the support mount 106 (such as shown in FIGS. 2-6) cooperate to secure to the backing plate 430 via the securing assembly 112 (which may or may not include the suction cup 114), as described herein. In at least one embodiment, a portion of the suction coup 114 that is configured to provide suction in relation to a surface of a component is selectively removable from the securing assembly 112.

The base 102 may be removably coupled to the platform 442 (which may include a horizontal support plate) through one or more spring buttons. The platform 442 may remain secured to the base 102 and deter removal of the fluid container 101 from the fluid container retaining system 100. That is, the base 102 being secured to the platform 442 may make removal of the fluid container 101 more difficult, and thereby deter inadvertent or undesired removal of the fluid container 101.

In at least one embodiment, the support mount 106 may secure to the backing plate 430 by a plastic threaded nut that extends through the passage 432, and is held in place by a knob, as described with respect to FIGS. 20-41. The securing assembly 112, including the knob, nut, and/or the like, may or may not include a suction cup. That is, the suction cup (or a portion thereof) may be removed from the securing assembly 112 when the fluid container retaining system 100 is mounted on the floor 109 by the floor stand 400.

In at least one embodiment, the backing plate 403 may include one or more signs on a front face and/or a rear face. The signs may include text, graphics, and/or the like. The sign(s) may be integrally formed with the backing plate 403. As another example, the sign(s) may be separately secured to the backing plate 403.

As described, the extension beam 440 supports the fluid container 101 above a surface of a floor. The extension beam 440 may include more or less segments than described. The segments may be adjustable relative to one another. In at least one other embodiment, the extension beam 440 is a single, contiguous structure without multiple segments. As another example, the extension beam 440 may include telescoping portions.

One or more pads 450 may be disposed between the floor mount 402 and a floor 409. The pads 450 may be non-slip pads. For example, the pads 450 may be formed of rubber and reduce the risk of the fluid container retaining system 100 slipping on the floor. Alternatively, the pads 450 may not be used.

Figure 45:
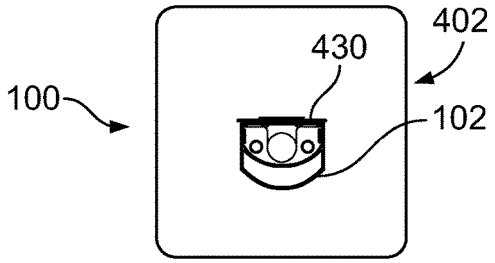
FIG. 45 illustrates a top view of the fluid container retaining system of FIG. 43.
Figure 46:
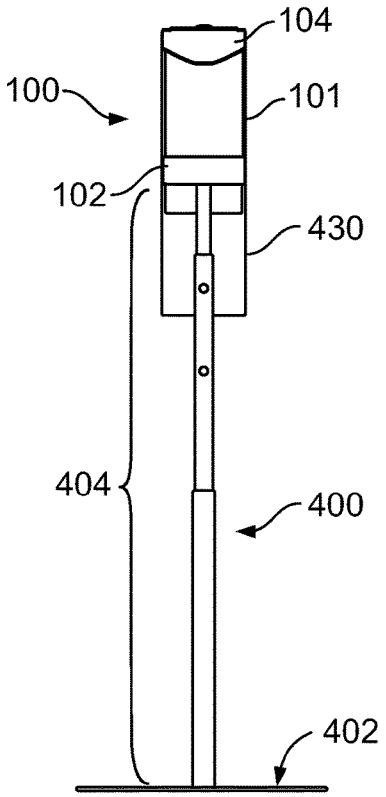
FIG. 46 illustrates a front view of the fluid container retaining system of FIG. 43.
Figure 47:
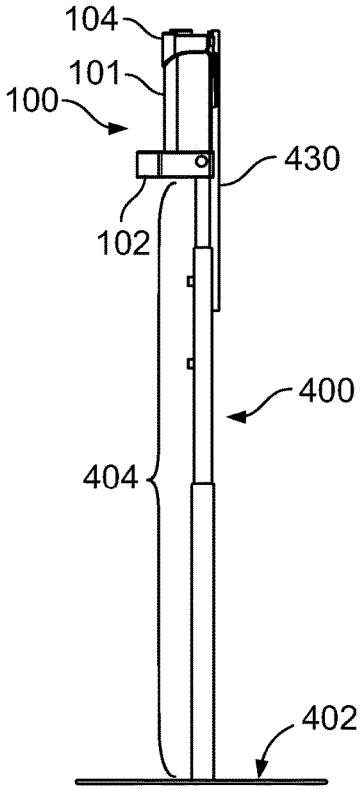
FIG. 47 illustrates a lateral view of the fluid container retaining system of FIG. 43.
Figure 48:
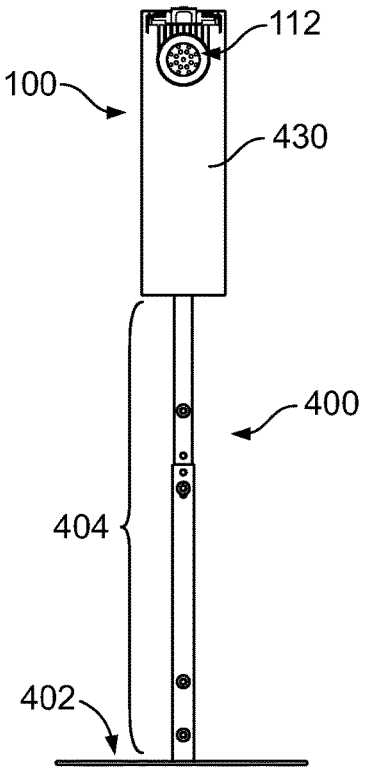
FIG. 48 illustrates a rear view of the fluid container retaining system of FIG. 43.

FIG. 45 illustrates a top view of the fluid container retaining system 100 of FIG. 43. FIG. 46 illustrates a front view of the fluid container retaining system 100 of FIG. 43. FIG. 47 illustrates a lateral view of the fluid container retaining system 100 of FIG. 43. FIG. 48 illustrates a rear view of the fluid container retaining system 100 of FIG. 43.

Figure 49:
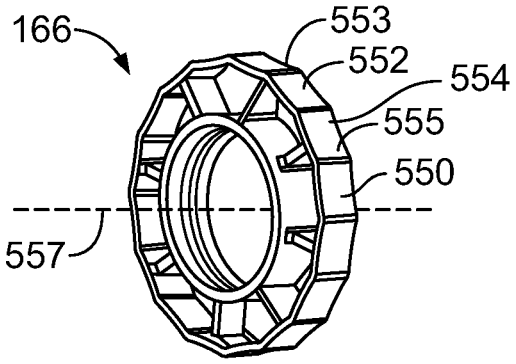
FIG. 49 illustrates a perspective rear view of a securing nut, according to an embodiment of the present disclosure.
Figure 50:
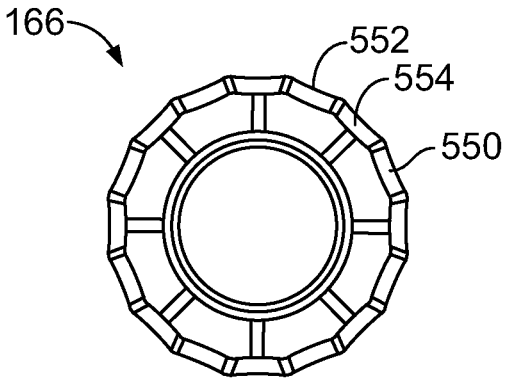
FIG. 50 illustrates a front view of the securing nut of FIG. 49.
Figure 51:
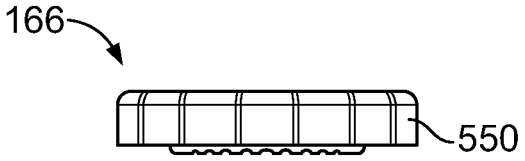
FIG. 51 illustrates a lateral view of the suction securing nut of FIG. 49.

FIG. 49 illustrates a perspective rear view of the suction securing nut 166, according to an embodiment of the present disclosure. FIG. 50 illustrates a front view of the suction securing nut 166 of FIG. 49. FIG. 51 illustrates a lateral view of the suction securing nut 166 of FIG. 49. Referring to FIGS. 49-51, the suction securing nut 166 can be used with any of the embodiments shown and described with respect to FIGS. 1-48. When portions the suction cup 114 of the securing assembly 112 are removed (such as when the system 100 is mounted on a floor, instead of secured to a surface through suction), the suction securing nut 116 may be referred to as a securing nut.

In at least one embodiment, the suction securing nut 166 includes a tactile outer perimeter 550 including a regularly alternating series of protuberances 552 and indentations 554. The protuberances 552 and indentations 554 provide tactile, ergonomic gripping features that allow an individual to easily and readily grasp and rotate the suction securing nut 166. Each of the protuberances 552 and indentations 554 may have a radius of curvature. For example, the protuberances 552 may have a first radius of curvature 553 (such as a curvature that is outwardly bowed away from a central axis 557 of the suction securing nut 166), and the indentations 554 may have a second radius of curvature 555 (such as a curvature that is inwardly bowed toward the central axis 557), which may be opposite the first radius of curvature, thereby providing the rounded peaks and valleys of the protuberances 552 and indentations 554, respectively. Alternatively, the securing nut 166 may not include the tactile outer perimeter 150. Instead, the outer perimeter may be smooth without indentations and protuberances. In at least one embodiment, the securing nut 166 is configured to mate with the stem 212, as shown in FIG. 38, for example.

As described herein, embodiments of the present disclosure provide fluid container retaining systems that are readily visible within an establishment, such as a grocery store, convenience store, restaurant, or the like. Further, embodiments of the present disclosure provide fluid container retaining systems that ensure that a fluid container is not inadvertently displaced, removed, or the like.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A fluid container retaining system, comprising:

a cover including a front wall that downwardly extends from a collar, wherein the collar includes lateral prongs separated by a central channel; and a support mount configured to cooperate with the cover to securely retain a first portion of a fluid container between the front wall, the lateral prongs, and the support mount, wherein the cover is removable from the support mount, wherein the cover is configured to removably secure to the support mount to trap and constrain the first portion of the fluid container therebetween, and wherein the support mount comprises a securing assembly having a suction cup that is configured to removably secure the fluid container retaining system to a surface of a structure.

2. The fluid container retaining system of claim 1, further comprising a stand configured to secure to a second portion of the fluid container.

3. The fluid container retaining system of claim 2, wherein the first portion of the fluid container is a neck, and wherein the second portion of the fluid container is a lower end.

4. The fluid container retaining system of claim 2, wherein the stand comprises:

a drip chamber configured to catch fluid dispensed from a pump of the fluid container; and a bottle retaining chamber configured to retain the second portion of the fluid container, wherein the bottle retaining chamber is separated from the drip chamber.

5. The fluid container retaining system of claim 2, wherein the stand further comprises a base having a flat surface that is configured to be supported on a level surface.

6. The fluid container retaining system of claim 2, further comprising an opening, wherein the stand is configured to be mounted over a portion of the fluid container and provide a filling device for the fluid container through the opening.

7. The fluid container retaining system of claim 1, wherein the cover and the support mount are configured to snapably secure together to trap the first portion of the fluid container therebetween.

8. The fluid container retaining system of claim 1, wherein the securing assembly of the support mount comprises:

a securing rim having a passage;

the suction cup having a stem, wherein the stem extends into and through the passage; and a suction securing nut that secures to the stem.

9. The fluid container retaining system of claim 8, wherein the securing rim further comprises a locking member.

10. The fluid container retaining system of claim 1, wherein the securing assembly further comprises an adhesive disc secured to the suction cup.

11. The fluid container retaining system of claim 1, wherein the support mount is configured to removably retain a sign.

12. The fluid container retaining system of claim 1, further comprising a floor stand that is configured to support the fluid container above a floor.

13. The fluid container retaining system of claim 12, wherein the securing assembly secures the support mount to the floor stand.

14. The fluid container retaining system of claim 12, wherein at least a portion of the suction cup is removable from the securing assembly.

15. The fluid container retaining system of claim 12, wherein the floor stand comprises:

a floor mount; and an extension beam upwardly extending from the floor mount, wherein a stand that supports the fluid container is secured to the extension beam.

16. The fluid container retaining system of claim 15, wherein the extension beam comprises a plurality of segments.

17. The fluid container retaining system of claim 16, wherein at least two of the plurality of segments are adjustable.

18. A method, comprising:

removably coupling a cover from a support mount of a fluid container retaining system, wherein the cover is removable from the support mount, wherein the cover includes a front wall that downwardly extends from a collar, wherein the collar includes lateral prongs separated by a central channel;

securely retaining a first portion of a fluid container between the support mount, the front wall, and the lateral prongs; and removably securing the fluid container retaining system to a surface of a structure by a suction cup of a securing assembly of the support mount.

19. The method of claim 18, further comprising securing a second portion of the fluid container to a stand of the fluid container retaining system.

20. The method of claim 19, further comprising:

catching, by a drip chamber of the stand, fluid dispensed from a pump of the fluid container; and retaining, by a bottle retaining chamber separated from the drip chamber, the second portion of the fluid container.

21. The method of claim 19, further comprising supporting a base of the stand on a level surface.

22. The method of claim 19, further comprising:

mounting the stand over a portion of the fluid container; and filling the fluid container through an opening of the stand.

23. The method of claim 18, wherein the removably coupling the cover from the support mount of the fluid container retaining system comprises snapably securing the cover and the support mount together to trap the first portion of the fluid container therebetween.

24. The method of claim 18, wherein the securing assembly of the support mount comprises:

a securing rim having a passage and a locking member;

wherein a stem of the suction cup extends into and through the passage; and a suction securing nut that secures to the stem.

25. The method of claim 18, further comprising securing and adhesive disc to the suction cup.

26. The method of claim 18, further comprising removably retaining, by the support mount, a sign.

27. The method of claim 18, further comprising stand supporting the fluid container above a floor with a floor stand.

28. A fluid container retaining system, comprising:

a cover including a front wall that downwardly extends from a collar, wherein the collar includes lateral prongs separated by a central channel;

a support mount configured to cooperate with the cover to securely retain a neck of a fluid container between the front wall, the lateral prongs, and the support mount, wherein the support mount comprises a securing assembly configured to removably secure the fluid container retaining system to a surface of a structure, wherein the cover and the support mount are configured to snapably secure together to trap the neck of the fluid container therebetween, wherein the support mount is configured to removably retain a sign, wherein the securing assembly of the support mount comprises:

a securing rim having a passage and a locking member;

a suction cup having a stem, wherein the stem extends into and through the passage; and a suction securing nut that secures to the stem; and a stand configured to secure to a lower end of the fluid container, wherein the stand comprises:

a drip chamber configured to catch fluid dispensed from a pump of the fluid container;

a bottle retaining chamber configured to retain the lower of the fluid container, wherein the bottle retaining chamber is separated from the drip chamber;

a base having a flat surface that is configured to be supported on a level surface; and an opening, wherein the stand is configured to be mounted over a portion of the fluid container and provide a filling device for the fluid container through the opening.

* * * * *